US010057946B2

(12) United States Patent
Mills et al.

(10) Patent No.: US 10,057,946 B2
(45) Date of Patent: Aug. 21, 2018

(54) ADAPTIVE COOKING CONTROL FOR AN OVEN

(75) Inventors: Nigel G. Mills, Kettering, OH (US); Richard W. Cartwright, Piqua, OH (US); Richard A. Kice, Tipp City, OH (US)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 1078 days.

(21) Appl. No.: 13/274,600

(22) Filed: Oct. 17, 2011

(65) Prior Publication Data

US 2013/0092682 A1 Apr. 18, 2013

(51) Int. Cl.

*H05B 6/68* (2006.01)
*H05B 1/02* (2006.01)
*H05B 6/64* (2006.01)

(52) U.S. Cl.

CPC ..... *H05B 6/687* (2013.01); *H05B 1/0263* (2013.01); *H05B 6/647* (2013.01); *H05B 6/6435* (2013.01)

(58) Field of Classification Search

CPC ..... F24C 7/086; F24C 7/082; F24C 7/085; H05B 1/0263; H05B 6/6435; H05B 6/647; H05B 6/687

USPC ..... 219/702, 700, 698, 704–705, 709–719; 99/342

See application file for complete search history.

(56) References Cited

U.S. PATENT DOCUMENTS 4,162,381 A * 7/1979 Buck ..... 219/705
4,340,796 A 7/1982 Yamaguchi et al.
4,396,817 A * 8/1983 Eck et al. ..... 219/685
4,517,429 A 5/1985 Horinouchi
6,750,433 B2 6/2004 Guenther et al.
6,809,301 B1 10/2004 McIntyre et al.
6,936,801 B1 8/2005 Head (Continued)

FOREIGN PATENT DOCUMENTS

WO 2005067639 7/2005
WO 2011100008 8/2011

OTHER PUBLICATIONS

International Search Report and Written Opinion of corresponding PCT/US2012/059927 dated Dec. 19, 2012.

(Continued)

*Primary Examiner* — Tu B Hoang
*Assistant Examiner* — Diallo I Duniver
(74) *Attorney, Agent, or Firm* — McNair Law Firm, P.A.

(57) ABSTRACT

An oven includes a cooking chamber configured to receive a food product, a user interface configured to display information associated with processes employed for cooking, first and second energy sources, and a cooking controller. The first energy source provides primary heating and the second energy source provides secondary heating for the food product. The cooking controller executes instructions associated with a cooking program directing application of energy to the food product via the first or second energy sources. The cooking controller includes processing circuitry configured to monitor energy added to the food product via the first energy source in accordance with the cooking program, receive an indication of a change to a cooking parameter associated with a second energy source, and determine a modification to the cooking program by employing a modification algorithm based on the cooking parameter change.

19 Claims, 17 Drawing Sheets

(56) References Cited

U.S. PATENT DOCUMENTS

| | | | | |
|---|---|---|---|---|
| 7,069,091 | B2 | 6/2006 | Williamson | |
| 7,092,988 | B1 | 8/2006 | Bogatin et al. | |
| 7,351,941 | B2 | 4/2008 | Kim | |
| 2008/0134904 | A1* | 6/2008 | Heitmann et al. | 99/342 |
| 2008/0290087 | A1 | 11/2008 | Ben-Shmuel et al. | |
| 2009/0011101 | A1* | 1/2009 | Doherty et al. | 426/523 |
| 2009/0045191 | A1 | 2/2009 | Ben-Shmuel et al. | |
| 2009/0057302 | A1 | 3/2009 | Ben-Shmuel et al. | |
| 2009/0134151 | A1* | 5/2009 | Bogatin et al. | 219/681 |
| 2009/0236333 | A1 | 9/2009 | Ben-Shmuel et al. | |
| 2009/0236334 | A1 | 9/2009 | Ben-Shmuel et al. | |
| 2009/0236335 | A1 | 9/2009 | Ben-Shmuel et al. | |
| 2010/0006564 | A1 | 1/2010 | Ben-Shmuel et al. | |
| 2010/0006565 | A1 | 1/2010 | Ben-Shmuel et al. | |
| 2010/0193507 | A1 | 8/2010 | Zimmer et al. | |
| 2011/0017728 | A1 | 1/2011 | Ben-Shmuel et al. | |
| 2011/0031236 | A1 | 2/2011 | Ben-Shmuel et al. | |
| 2011/0031240 | A1 | 2/2011 | Ben-Shmuel et al. | |
| 2011/0033584 | A1 | 2/2011 | Bilchinsky et al. | |

OTHER PUBLICATIONS

Office Action of corresponding Chinese application No. 201280060335.1, dated Apr. 30, 2015, all enclosed pages cited.

* cited by examiner

ADAPTIVE COOKING CONTROL FOR AN OVEN

TECHNICAL FIELD

Example embodiments generally relate to ovens and, more particularly, relate to an oven that is enabled to cook food with multiple energy sources and adaptively account for the energy added by each respective source.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and cannot brown most foods. Given that browning may add certain desirable characteristics in relation to taste and appearance, it may be necessary to employ another cooking method in addition to microwave cooking in order to achieve browning. The application of heat for purposes of browning, however, may further the cooking process and begin to dry out or otherwise negatively impact the final product. For many combination ovens, striking a balance between browning and cooking can be a difficult manual process of trial and error.

BRIEF SUMMARY OF SOME EXAMPLES

Some example embodiments may provide an oven that employs multiple cooking sources that are electronically controlled via processing circuitry. The cooking sources may be balanced, under control of the processing circuitry, in consideration of the degree of energy added by each source. The processing circuitry may therefore provide the oven with the ability to monitor or estimate the energy added to food product by a first energy source and, based on changes to parameters impactful of another way of adding energy to the food product during the cooking process by a second energy source, determine a modification to the energy to be added or cooking time for the food product.

In one example embodiment, an oven is provided. The oven may include a cooking chamber, a user interface, a first energy source, a second energy source and a cooking controller. The cooking chamber may be configured to receive a food product. The user interface may be configured to display information associated with processes employed for cooking the food product. The first energy source may provide primary heating of the food product placed in the cooking chamber. The second energy source may provide secondary heating for the food product. The cooking controller may be operably coupled to the first and second energy sources to execute instructions associated with a cooking program directing application of energy to the food product via at least one of the first or second energy sources. The cooking controller may include processing circuitry configured to monitor energy added to the food product via the first energy source in accordance with the cooking program, receive an indication of an operator inserted change to a cooking parameter associated with a second energy source, and determine a modification to the cooking program by employing a modification algorithm based on the cooking parameter change. The modification algorithm may include instructions for determining a change to the energy to be applied via the first energy source to achieve a selected level of doneness associated with the cooking program, an amount of energy provided by the first energy source up to a point in the cooking program at which the cooking parameter change was made, and the cooking parameter change associated with the second energy source.

In another example embodiment, a cooking controller for use in an oven including a first energy source providing primary heating of a food product placed in the oven and a second energy source providing secondary heating for the food product is provided. The cooking controller may be operably coupled to the first and second energy sources to execute instructions associated with a cooking program directing application of energy to the food product via at least one of the first or second energy sources. The cooking controller may include processing circuitry configured to monitor energy added to the food product via the first energy source in accordance with the cooking program, receive an indication of an operator inserted change to a cooking parameter associated with a second energy source, and determine a modification to the cooking program by employing a modification algorithm based on the cooking parameter change. The modification algorithm may include instructions for determining a change to the energy to be applied via the first energy source to achieve a selected level of doneness associated with the cooking program, an amount of energy provided by the first energy source up to a point in the cooking program at which the cooking parameter change was made, and the cooking parameter change associated with the second energy source.

In another example embodiment, a method of controlling an oven including a first energy source providing primary heating of a food product placed in the oven and a second energy source providing secondary heating for the food product is provided. The method may include monitoring, via processing circuitry associated with a cooking controller operably coupled to the first and second energy sources, energy added to the food product via the first energy source in accordance with a cooking program directing application of energy to the food product via at least one of the first or second energy sources. The method may further include receiving an indication of an operator inserted change to a cooking parameter associated with a second energy source. The method may further include determining, via the processing circuitry, a modification to the cooking program by employing a modification algorithm based on the cooking parameter change. The modification algorithm may include instructions for determining a change to the energy to be applied via the first energy source to achieve a selected level of doneness associated with the cooking program, an amount of energy provided by the first energy source up to a point in the cooking program at which the cooking parameter change was made, and the cooking parameter change associated with the second energy source.

Some example embodiments may improve the cooking performance and/or improve the operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
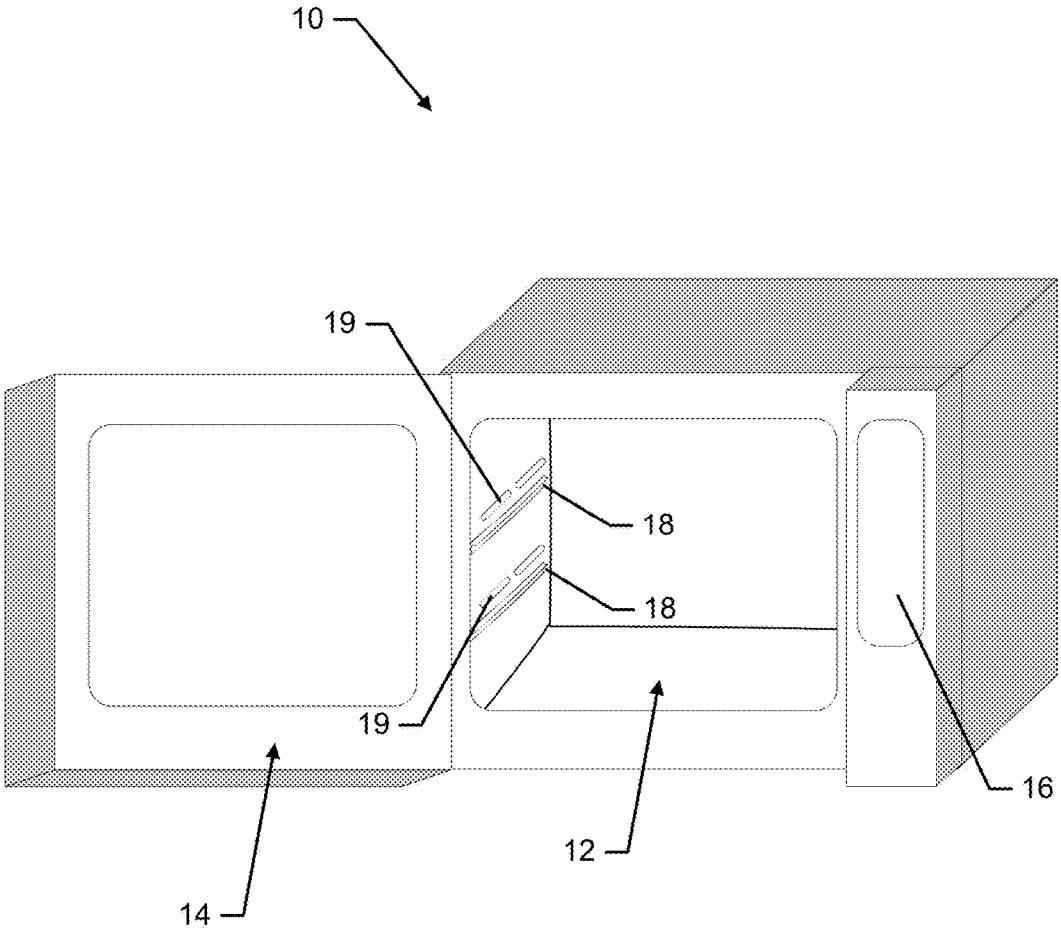
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other. Furthermore, as used herein the term "browning" should be understood to refer to the Maillard reaction or other desirable food coloration reactions whereby the food product is turned brown via enzymatic or non-enzymatic processes.

Some example embodiments may improve the cooking performance of an oven and/or may improve the operator experience of individuals employing an example embodiment. In this regard, since processing circuitry that controls the application of various heating sources can be used to account for the amount of contribution to the cooking process that is added by each of the energy sources in order to achieve a desired cooking result with increased accuracy and/or certainty. Thus, in some cases, a better cooked product may be achieved. Moreover, by monitoring the energy added via one energy source, changes in cooking parameters relating to another energy source may be accounted for with respect to providing a target amount of total energy or providing energy for a target amount of time. As such, the operator may be enabled to manually control one of the energy sources and corresponding changes to the amount of energy added by another energy source may be automatically inserted to account for the manual control inputs and achieve a desired cooking result. For example, parameters associated with browning may be monitored to determine an impact on the amount of energy being added by, for example, radio frequency (RF) energy. Excess drying or other negative impacts associated with heating browned foods may therefore be avoided.

FIG. 1 illustrates a perspective view of an oven 10 according to an example embodiment. As shown in FIG. 1, the oven 10 may include a cooking chamber 12 into which a food product may be placed for the application of heat by any of at least two energy sources that may be employed by the oven 10. The cooking chamber 12 may include a door 14 and an interface panel 16, which may sit proximate to the door 14 when the door 14 is closed. In an example embodiment, the interface panel 16 may include a touch screen display capable of providing visual indications to an operator and further capable of receiving touch inputs from the operator. The interface panel 16 may be the mechanism by which instructions are provided to the operator, and the mechanism by which feedback is provided to the operator regarding cooking process status, options and/or the like.

In some embodiments, the oven 10 may include multiple racks or may include rack (or pan) supports 18 or guide slots in order to facilitate the insertion of one or more racks or pans holding food product that is to be cooked. In an example embodiment, airflow slots 19 may be positioned proximate to the rack supports 18 (e.g., above the rack supports in one embodiment) to enable air to be forced over a surface of food product placed in a pan or rack associated with the corresponding rack supports 18. Food product placed on any one of the racks (or simply on a base of the cooking chamber 12 in embodiments where multiple racks are not employed) may be heated at least partially using radio frequency (RF) energy. Meanwhile, the airflow that may be provided may be heated to enable browning to be accomplished as described in greater detail below.

Figure 2:
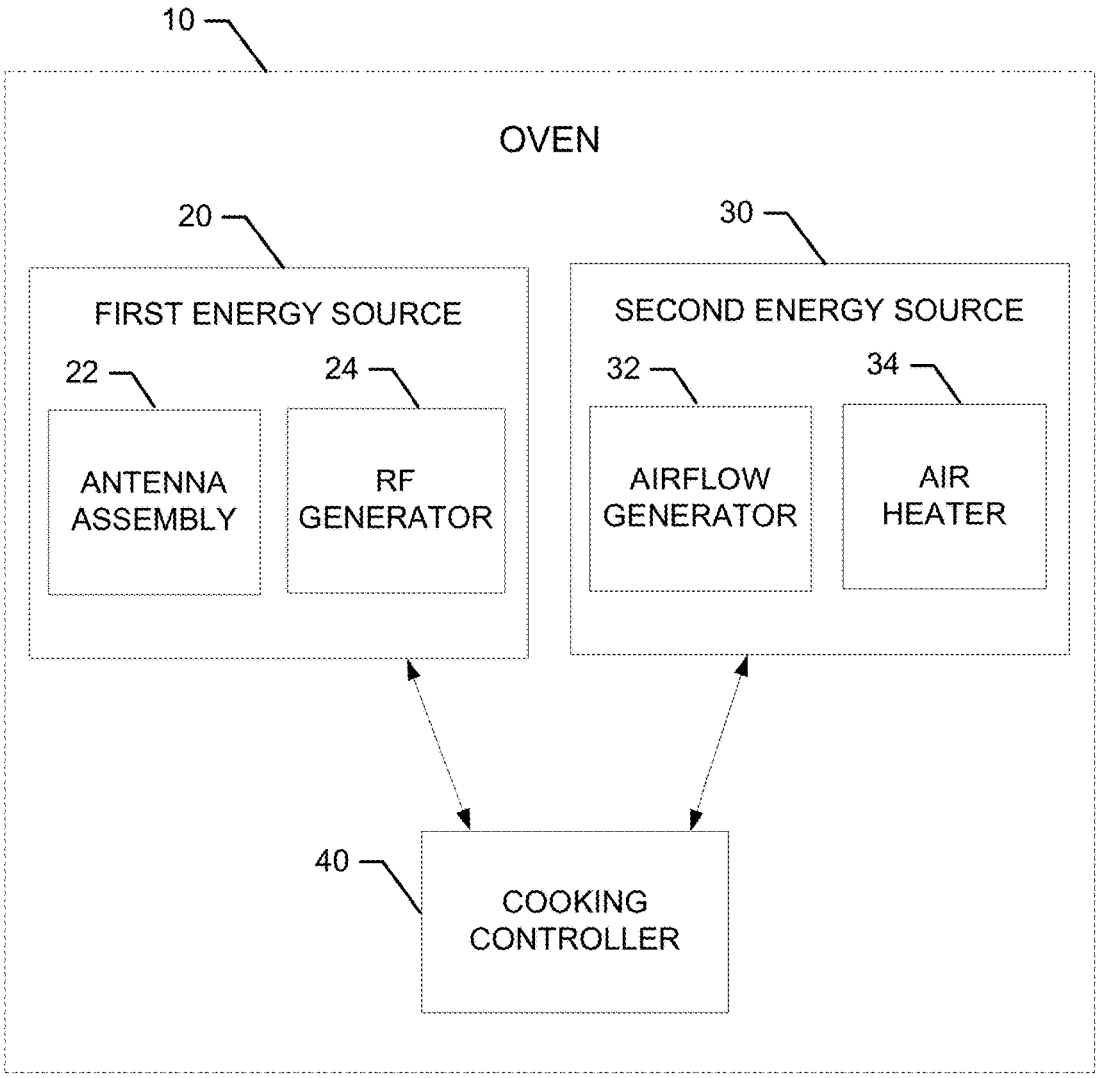
FIG. 2 illustrates a functional block diagram of the oven of FIG. 1 according to an example embodiment.

FIG. 2 illustrates a functional block diagram of the oven 10 according to an example embodiment. As shown in FIG. 2, the oven 10 may include at least a first energy source 20 and a second energy source 30. The first and second energy sources 20 and 30 may each correspond to respective different cooking methods. However, it should be appreciated that additional energy sources may also be provided in some embodiments.

In an example embodiment, the first energy source 20 may be an RF energy source configured to generate relatively broad spectrum RF energy to cook food product placed in the cooking chamber 12 of the oven 10. Thus, for example, the first energy source 20 may include an antenna assembly 22 and an RF generator 24. The RF generator 24 of one example embodiment may be configured to generate RF energy at selected levels over a range of 800 MHz to 1 GHz. The antenna assembly 22 may be configured to transmit the RF energy into the cooking chamber 12 and receive feedback to indicate absorption levels of respective different frequencies in the food product. The absorption levels may then be used, at least in part, to control the generation of RF energy to provide balanced cooking of the food product.

In some example embodiments, the second energy source 30 may be an energy source capable of inducing browning of the food product. Thus, for example, the second energy source 30 may include an airflow generator 32 and an air heater 34. However, in some cases, the second energy source 30 may be an infrared energy source, or some other energy source. In examples where the second energy source 30 includes the airflow generator 32, the airflow generator 32 may include a fan or other device capable of driving airflow through the cooking chamber 12 and over a surface of the food product (e.g., via the airflow slots). The air heater 34 may be an electrical heating element or other type of heater that heats air to be driven over the surface of the food product by the airflow generator 32. Both the temperature of the air and the speed of airflow will impact browning times that are achieved using the second energy source 30.

In an example embodiment, the first and second energy sources 20 and 30 may be controlled, either directly or indirectly, by a cooking controller 40. Moreover, it should be appreciated that either or both of the first and second energy sources 20 and 30 may be operated responsive to settings or control inputs that may be provided at the beginning, during or at the end of a program cooking cycle. Furthermore, energy delivered via either or both of the first and second energy sources 20 and 30 may be displayable via operation of the cooking controller 40. The cooking controller 40 may be configured to receive inputs descriptive of the food product and/or cooking conditions in order to provide instructions or controls to the first and second energy sources 20 and 30 to control the cooking process. The first energy source 20 may be said to provide primary heating of the food product, while the second energy source 30 provides secondary heating of the food product. However, it should be appreciated that the terms primary and secondary in this context do not necessarily provide any indication of the relative amounts of energy added by each source. Thus, for example, the secondary heating provided by the second energy source 30 may represent a larger total amount of energy than the primary heating provided by the first energy source 20. Thus, the term "primary" may indicate a temporal relationship and/or may be indicative of the fact that the first energy source is an energy source that can be directly measured, monitored and displayed. In some embodiments, the cooking controller 40 may be configured to receive both static and dynamic inputs regarding the food product and/or cooking conditions. Dynamic inputs may include feedback data regarding absorption of RF spectrum, as described above. In some cases, dynamic inputs may include adjustments made by the operator during the cooking process (e.g., to control the first energy source 20 or the second energy source 30), or changing (or changeable) cooking parameters that may be measured via a sensor network. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), and/or the like.

In some embodiments, the cooking controller 40 may be configured to access data tables that define RF cooking parameters used to drive the RF generator 34 to generate RF energy at corresponding levels and/or frequencies for corresponding times determined by the data tables based on initial condition information descriptive of the food product. As such, the cooking controller 40 may be configured to employ RF cooking as a primary energy source for cooking the food product. However, other energy sources (e.g., secondary and tertiary or other energy sources) may also be employed in the cooking process. In some cases, programs or recipes may be provided to define the cooking parameters to be employed for each of multiple potential cooking stages that may be defined for the food product and the cooking controller 40 may be configured to access and/or execute the programs or recipes. In some embodiments, the cooking controller 40 may be configured to determine which program to execute based on inputs provided by the user. In an example embodiment, an input to the cooking controller 40 may also include browning instructions or other instructions that relate to the application of energy from a secondary energy source (e.g., the second energy source 30). In this regard, for example, the browning instructions may include instructions regarding the air speed, air temperature and/or time of application of a set air speed and temperature combination. The browning instructions may be provided via a user interface as described in greater detail below, or may be provided via instructions associated with a program or recipe. Furthermore, in some cases, initial browning instructions may be provided via a program or recipe, and the operator may make adjustments to the energy added by the second energy source 30 in order to adjust the amount of browning to be applied. In such a case, an example embodiment may employ the cooking controller 40 to account for changes made to the amount of energy to be added by the second energy source 30, by adjusting the amount of energy to be added via the first energy source 20.

Figure 3:
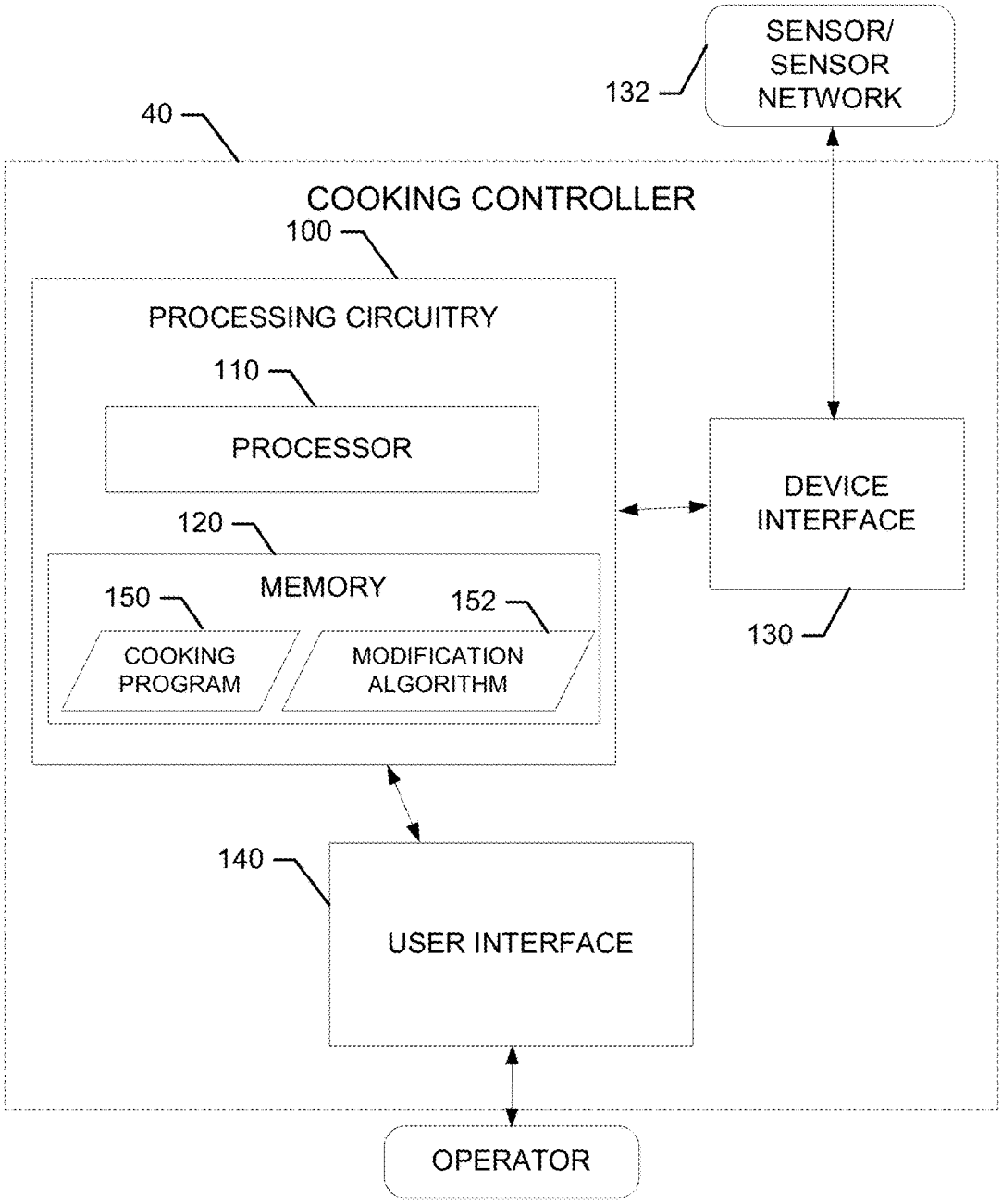
FIG. 3 illustrates a block diagram of a cooking controller according to an example embodiment.

FIG. 3 illustrates a block diagram of the cooking controller 40 according to an example embodiment. In some embodiments, the cooking controller 40 may include or otherwise be in communication with processing circuitry 100 that is configurable to perform actions in accordance with example embodiments described herein. As such, for example, the functions attributable to the cooking controller 40 may be carried out by the processing circuitry 100.

The processing circuitry 100 may be configured to perform data processing, control function execution and/or other processing and management services according to an example embodiment of the present invention. In some embodiments, the processing circuitry 100 may be embodied as a chip or chip set. In other words, the processing circuitry 100 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 100 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 100 may include a processor 110 and memory 120 that may be in communication with or otherwise control a device interface 130 and, a user interface 140. As such, the processing circuitry 100 may be embodied as a circuit chip (e.g., an integrated circuit chip) configured (e.g., with hardware, software or a combination of hardware and software) to perform operations described herein. However, in some embodiments, the processing circuitry 100 may be embodied as a portion of an on-board computer.

The user interface 140 (which may be embodied as, include, or be a portion of the interface panel 16) may be in communication with the processing circuitry 100 to receive an indication of a user input at the user interface 140 and/or to provide an audible, visual, mechanical or other output to the user (or operator). As such, the user interface 140 may include, for example, a display (e.g., a touch screen), one or more hard or soft buttons or keys, and/or other input/output mechanisms. In some embodiments, the user interface 140 may be provided on a front panel (e.g., positioned proximate to the door 14), on a portion of the oven 10.

The device interface 130 may include one or more interface mechanisms for enabling communication with other devices such as, for example, sensors of a sensor network (e.g., sensor/sensor network 132) of the oven 10, removable memory devices, wireless or wired network communication devices, and/or the like. In some cases, the device interface 130 may be any means such as a device or circuitry embodied in either hardware, or a combination of hardware and software that is configured to receive and/or transmit data from/to sensors that measure any of a plurality of device parameters such as frequency, temperature (e.g., in the cooking chamber 12 or in air passages associated with the second energy source 30), air speed, and/or the like. As such, in one example, the device interface 130 may receive input at least from a temperature sensor that measures the air temperature of air heated (e.g., by air heater 34) prior to introduction of such air (e.g., by the airflow generator 32) into the cooking chamber 12. In some cases, the sensor network 132 may also measure air speed directly (e.g., via pitot probes or other such devices) or indirectly (e.g., by recognizing fan speed or control signals applied to the airflow generator 32). Alternatively or additionally, the device interface 130 may provide interface mechanisms for any devices capable of wired or wireless communication with the processing circuitry 100.

In an exemplary embodiment, the memory 120 may include one or more non-transitory memory devices such as, for example, volatile and/or non-volatile memory that may be either fixed or removable. The memory 120 may be configured to store information, data, applications, instructions or the like for enabling the cooking controller 40 to carry out various functions in accordance with exemplary embodiments of the present invention. For example, the memory 120 could be configured to buffer input data for processing by the processor 110. Additionally or alternatively, the memory 120 could be configured to store instructions for execution by the processor 110. As yet another alternative, the memory 120 may include one or more databases that may store a variety of data sets responsive to input from the sensor network 132, or responsive to programming of any of various cooking programs. Among the contents of the memory 120, applications may be stored for execution by the processor 110 in order to carry out the functionality associated with each respective application. In some cases, the applications may include control applications that utilize parametric data to control the application of heat or energy by the first and second energy sources 20 and 30 as described herein. In this regard, for example, the applications may include operational guidelines defining expected browning speeds for given initial parameters (e.g., food type, size, initial state, location, and/or the like) using corresponding tables of temperatures and air speeds. Thus, some applications that may be executable by the processor 110 and stored in memory 120 may include tables plotting air speed and temperature to determine browning times for certain levels of browning (e.g. light, medium, heavy or any other level delineations that may be provided to describe a spectrum of possible browning characteristics that may be achieved).

The processor 110 may be embodied in a number of different ways. For example, the processor 110 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 110 may be configured to execute instructions stored in the memory 120 or otherwise accessible to the processor 110. As such, whether configured by hardware or by a combination of hardware and software, the processor 110 may represent an entity (e.g., physically embodied in circuitry—in the form of processing circuitry 100) capable of performing operations according to embodiments of the present invention while configured accordingly. Thus, for example, when the processor 110 is embodied as an ASIC, FPGA or the like, the processor 110 may be specifically configured hardware for conducting the operations described herein. Alternatively, as another example, when the processor 110 is embodied as an executor of software instructions, the instructions may specifically configure the processor 110 to perform the operations described herein.

In an example embodiment, the processor 110 (or the processing circuitry 100) may be embodied as, include or otherwise control the cooking controller 40. As such, in some embodiments, the processor 110 (or the processing circuitry 100) may be said to cause each of the operations described in connection with the cooking controller 40 by directing the cooking controller 40 to undertake the corresponding functionalities responsive to execution of instructions or algorithms configuring the processor 110 (or processing circuitry 100) accordingly. As an example, the cooking controller 40 may be configured to control RF energy application based on air speed, temperature and/or the time of application of heat based on browning characteristics input at the user interface 140. In some examples, the cooking controller 40 may be configured to make adjustments to the RF energy to be added (or the time of application of such energy) based on operator adjustments made to the temperature and/or air speed based on the browning instructions selected. Alternatively, the cooking controller 40 may be enabled to make adjustments to browning time based on the adjustment of either or both of the temperature and air speed.

As such, in some example embodiments, the cooking controller 40 may be configured to determine a cooking impact that energy addition associated with browning may provide to an already calculated cook time associated with another energy source (e.g., an RF energy source such as the first energy source 20). Thus, for example, if a cook time is determined for cooking relative to energy applied by the first energy source 20, and adjustments or inputs are made to direct usage of the second energy source 30 for browning, the cooking controller 40 may be configured to calculate adjustments (and apply such adjustments) to the cooking time of the first energy source 20 in order to ensure that the browning operation does not overcook or overheat the food product or undercook or underheat the food product. However, the cooking controller 40 is not only configured to determine the impact of changes to secondary energy sources. The cooking controller 40 is configured to determine the impact of any changes made (either before or during the cooking process) to instructions associated with the first energy source 20 or the second energy source 30 relative to a cooking program.

In an example embodiment, the cooking controller 40 may be configured to execute instructions to provide at least some control over the first and second energy sources 20 and 30. In this regard, for example, the cooking controller 40 (e.g., via the processor 110 or the processing circuitry 100) may be configured to execute instructions associated with a cooking program 150. The cooking program 150 may include instructions for cooking parameters (e.g., time, energy level, air temperature, frequency, air speed and/or the like) to be applied to food product to define a cooking sequence. In some embodiments, the cooking program 150 may be directly selected or defined by the operator (e.g., via the user interface 140). However, in some embodiments, the cooking program 150 may be selected by the cooking controller 40 based on inputs provided by the operator. The cooking program 150 may, for example, define a cooking time and an RF energy target for cooking the food product. In some cases, the cooking program 150 may further provide browning instructions defining an air speed and air temperature for energy to be added to brown the food product. Data associated with the cooking program 150 (e.g., a cooking time) may be displayed to the operator (e.g., via the user interface 140) and the operator may be further provided with an intuitive interface for controlling browning operations of the oven 10.

In situations where the operator elects to provide control instructions to impact application of the second energy source 30 (e.g., to adjust the browning level), the basic instructions of the cooking program 150 may be departed from, and thus a total amount of energy to be added to the food product may be modified. These changes may be input by the operator either before or during execution of the cooking program 150. To account for the departure, the cooking controller 40 may be configured to execute a modification algorithm 152. The modification algorithm 152 may provide a mechanism by which to adjust the energy to be added via the first energy source 20 to account for changes from the cooking program 150 that are inserted by the operator relative to energy being added via the second energy source 30. In an example embodiment, by executing the modification algorithm 152, the cooking controller 40 may be configured to establish revised cooking times and RF energy targets as a function of convective air speed and temperature, based on the instantaneous (or average) RF power delivered. The RF power delivered may be a GUI (computed and displayed on the graphical user interface)-measured RF power defined as the average power delivered to the food product from the start of cooking to the present time.

In some embodiments, the modification algorithm 152 may be determined based on a series of cooking time curves derived experimentally for each of a plurality of different categories of food products (or specific food products). The cooking time curves may be generated for selected doneness levels and may define various combinations of RF energy amounts, air speeds, and air temperatures required over given time periods to achieve the corresponding selected doneness levels. The doneness level may be a standardized value (e.g., an ASTM defined value) that may be determined for each respective food product or food product category based on a measurement of internal temperature or based on cooking to a specific percentage of weight loss. To determine the cooking time curves, initial temperature values, average ending temperature values, the specific heat of the food product or food product category, and the heat of fusion and/or heat of vaporization (since some of the energy delivered to the food product may be given up as moisture or weight loss to steam) may be included among the parameters measured. A plurality of test cooking runs and corresponding data indicative of the mass, air speed and air temperature for cooking to desired doneness levels may therefore be used as data useable by the modification algorithm 152.

Figure 4A:
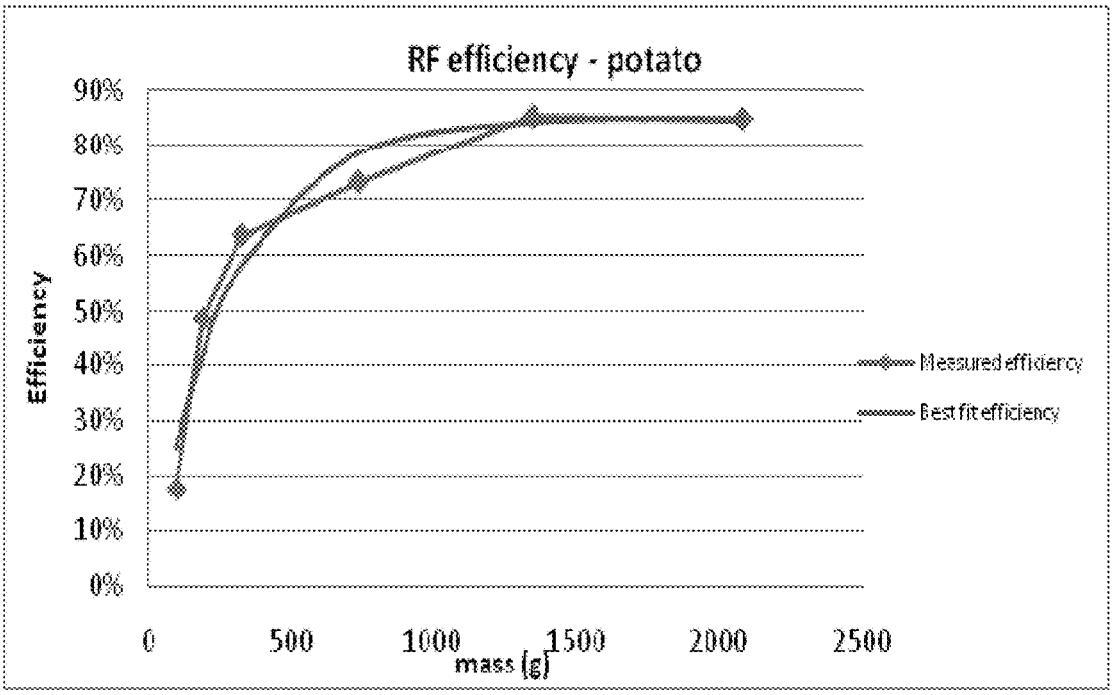
FIG. 4A illustrates an example curve for determining RF efficiency of a particular food product or food product category based on mass according to an example embodiment.
Figure 4B:
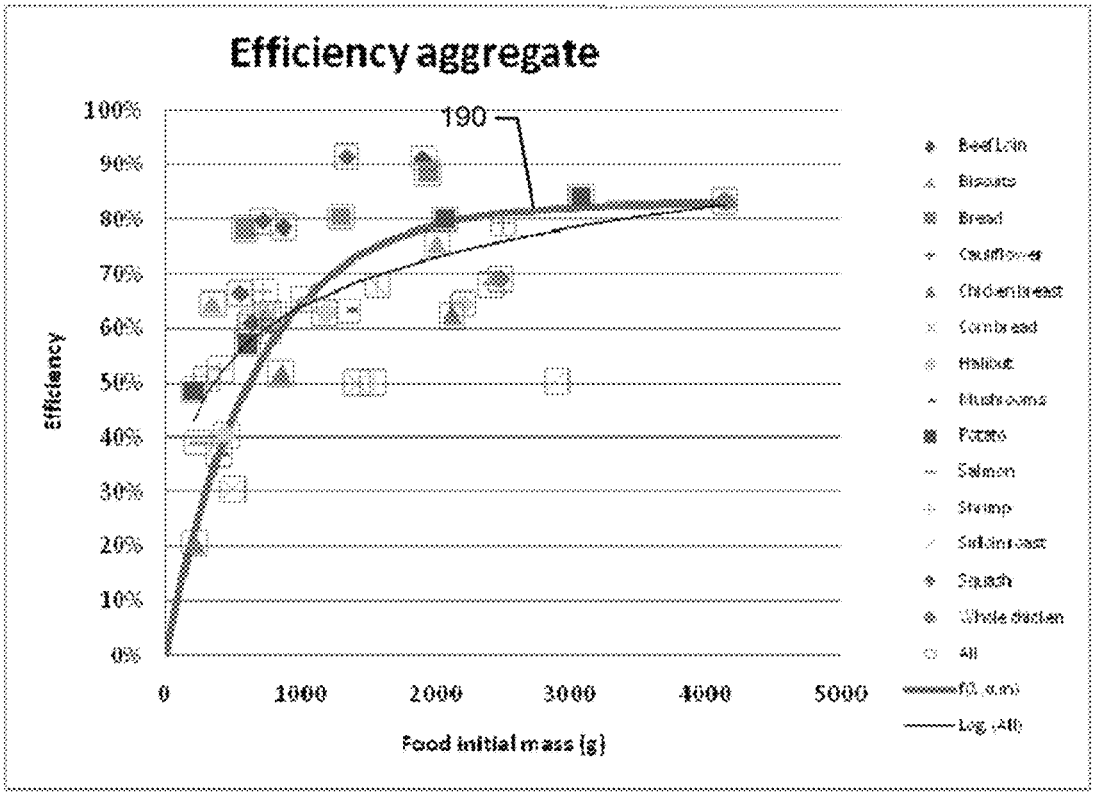
FIG. 4B illustrates an example curve showing RF efficiency of a plurality of food products based on mass according to an example embodiment.

In some cases, the RF efficiency for each food product or food product category may also be determined. The RF efficiency may indicate how efficient the corresponding food product or food product category is at absorbing RF energy. In some cases, the RF efficiency may be a function of mass. Thus, the initial mass of a food product is used as an input to enable the cooking controller 40 to execute the modification algorithm 152. FIG. 4A illustrates an example chart showing the RF efficiency of an example food product as a function of the mass of the example food product, while FIG. 4B illustrates an example chart showing RF efficiency for a plurality of other food products as a function of mass. Generally, the total energy delivered to a food product ($E_f$) is given by:

$$E_f = E_\mu + E_c \quad (1$$

where $E_\mu$ is the energy delivered by the RF energy source (e.g., the first energy source 20) and $E_c$ is the energy delivered by convection (e.g., by the second energy source 30). However, it should be appreciated that other energy sources may also contribute in other examples where more than just two energy sources are employed. The RF energy may be determined from the GUI (computed and displayed on the graphical user interface) combined with separately measured efficiency ($Eff_\mu$) as a function of mass:

$$E_\mu = E_{GUI} \times Eff_\mu \quad (2$$

The "best fit" curve used for this particular example food product is:

$$Eff_\mu = 0.85*(1-e^{-0.0035\times m}) \quad (3$$

In a case in which one is interested in cooking time as a function of $E_\mu$, the total energy delivered to the food product may be written as:

$$E_f = t\times(P_\mu + P_c) \quad (4$$

where $P_\mu$ is the average power delivered by the RF and $P_c$ is the average energy delivered by convection. In other words, the energy delivered to the food ($E_f$) is the sum of the energy absorbed as sensible heat and the energy absorbed as latent heat. Now $P_c$ will vary with convection air speed (S) and air temperature ($T_c$).

For given controlled conditions, $E_f$ can be computed from physical parameters and measured weight loss. Cook time (t), and $P_\mu$ may be recorded so that $P_c$ may be determined as a function of the mass of food product cooked. Once a value for $P_c$ is determined, a new total cook time [$t_{new}$(m)] may be expressed as a function of known parameters for a given mass based on Equation (4) to get Equation (5):

$$t_{new}(m, S, T_c) = \frac{E_f(m)}{(P_\mu(m) + P_c(m, S, T_c))} \quad (5$$

An estimate of the energy delivered to the food product $E_f(m)$ from the thermodynamic properties of the food product may then be determined.

$$E_f(m)=m\times C_p(C)\times\Delta T+\Delta m\times H_v \quad (6$$

where the total energy delivered to the food is a combination of the sensible and latent heat components. The sensible heat component is provided by the mass, specific heat and change in temperature. The latent heat component is provided by the change in mass and the heat of vaporization value. The parameter Δm is the weight loss due to water vaporization. From experimental data, a heuristic ("rule of thumb") expression for $P_c(m,S,T_c)$ may be determined. In this regard, for example, $P_c$ may be directly proportional to the mass of the food and $P_c$ may be zero for zero mass. In other words, the energy "available" from heating elements may be large enough to maintain air temperature and convective heat delivery may be at a constant value of kJ/kg−s. With S and $T_c$ changing, it may be assumed that k is a function of both parameters in the equation:

$$P_c(m,S,T_c)=k(S\times T_c)\times m \quad (7$$

It may then be assumed that:

$$k\propto S^x\times T_c^y \quad (8$$

where S is the airspeed represented in the data by the fan rotation rate in revolutions per minute (RPM), convection air temperature ($T_c$) is measured in Celsius, and k is indicative of a slope of the relationship between power and mass for a given air speed and air temperature. In some cases, k may be the same for entire categories or classes of food products. Intuitively $P_c(m,S,T_c)$ increases with both S and $T_c$. In some cases, setting values x and y to unity may achieve satisfactory results.

Figure 5A:
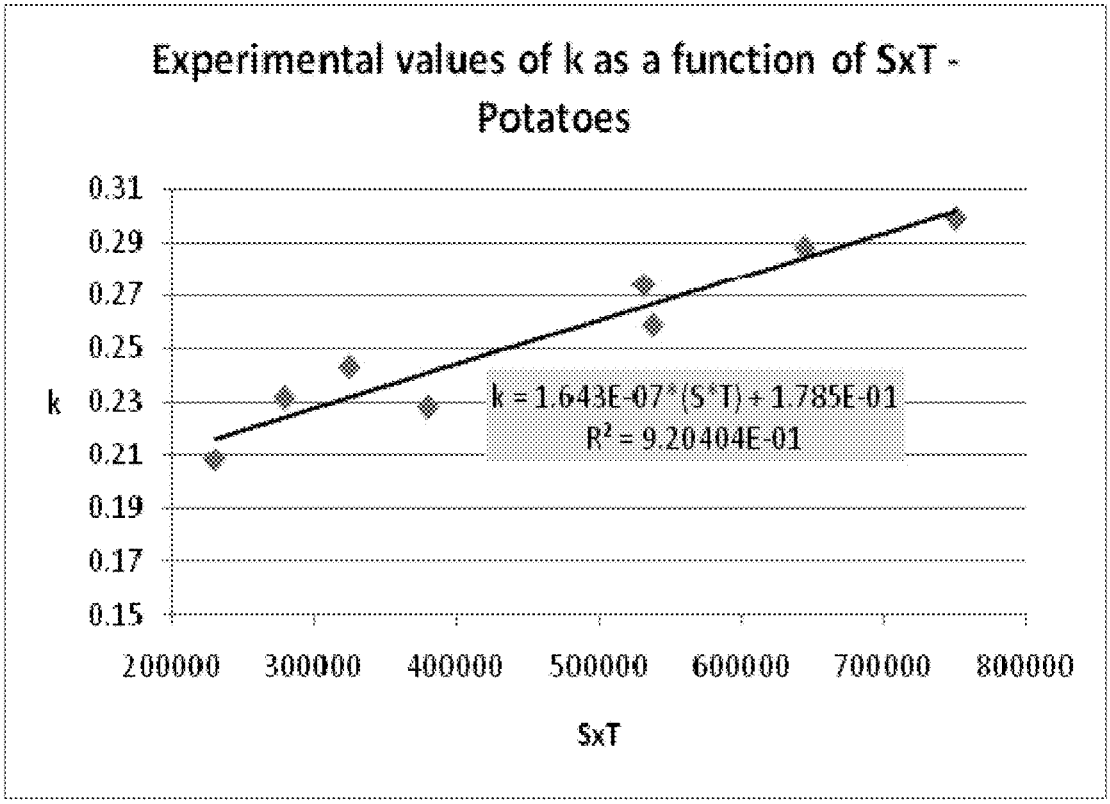
FIG. 5A illustrates a chart of experimental values of k as a function of air speed and air temperature for a particular food product according to an example embodiment.
Figure 5B:
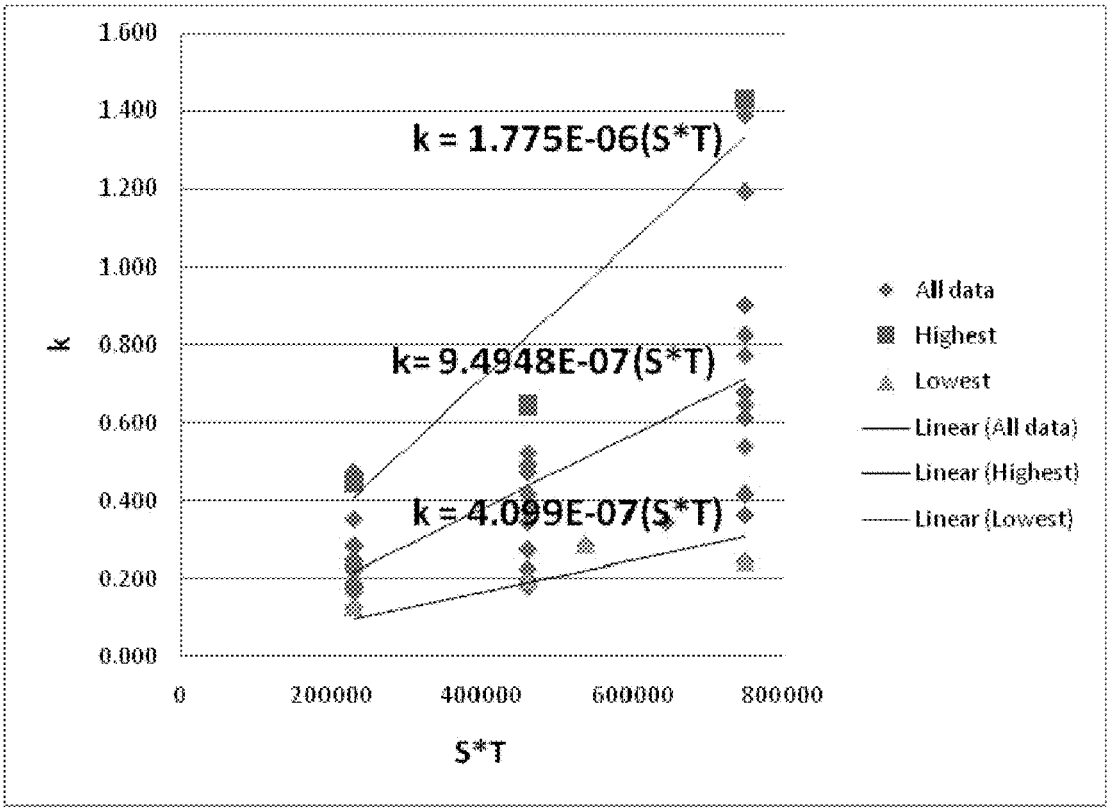
FIG. 5B illustrates a chart of experimental values of k as a function of air speed and air temperature for a plurality of food products according to an example embodiment.

FIG. 5A illustrates a chart showing experimental values of k as a function of air speed and air temperature for a food product, and FIG. 5B illustrates a chart showing experimental values of k as a function of air speed and air temperature for a plurality of different food types. Using the trend line function of FIG. 5A:

$$k=1.643\times10^{-7}\times(S\times T)+1.785\times10^{-1} \quad (9$$

In some embodiments, all parameters needed to consider different scenarios of RF energy delivery, and user-selected air speed and convection temperature may therefore be determined. Rather than calculating an instantaneous power, an average power ($P_{\mu_avg}$) may be determined and maintained. The average power ($P_{\mu_avg}$) may be defined as:

$$P_{\mu_{avg}}(m) = \frac{E_{\mu_inst} \times Eff(m)}{t_{elapsed}} \quad (10$$

where $E_{\mu_inst}$ is the GUI-measured accumulated RF energy at a specific elapsed time ($t_{elapsed}$) and Eff(m) is the estimated RF efficiency for the mass. Computation of $P_{\mu_avg}$ may begin in only a few seconds after starting to execute any cooking program and can continue to be revised throughout a cook cycle.

Accordingly, from the two calculated parameters, $E_f(m)$ and $P_c(m,S,T_c)$, and the new GUI $P_{\mu_avg}$, a new cook time and a new GUI-displayed target RF energy value [$E_{\mu_new}$(m)] may be calculated (e.g., based on Equation (5)):

$$t_{new}(m) = \frac{E_f(m)}{(P_{\mu_{avg}}(m) + P_c(m, S, T))} \quad (11$$

and:

$$E_{\mu_{new}}(m) = t_{new}(m) \times P_{\mu_{avg}}(m)/Eff(m) \quad (12$$

The general form of equations (11) and (12) may apply to all food products and food product categories. Expressions for computing a new cook time and/or GUI RF target energy values may therefore be derived from experimental data as a function of m, S, T, $P_{\mu_avg}$ and Eff(m). In some embodiments, an initial estimate of time and RF energy may be provided before the operator hits the start button or otherwise commences a cooking operation. Accordingly, for example, the operator may be enabled to consider the time commitment required for the parameters selected and have the option to make adjustments to shorten or lengthen the time to complete cooking as desired. In some cases, an estimate of time may be provided by $t_{final_est}=(\delta*m+c)/(P_{\mu_hist+\kappa}*S*T*m)$ and an estimate of energy may be provided by $E_{GUI_final_est}=t_{final_est}*P_{\mu_hist}$ where $P_{\mu_hist}$ is a parameter that is calculated from experimentally determined constants for each food product and the mass of the food product. Equations (11) and (12) may replace these initial values relatively shortly after the cooking cycle is commenced.

Figure 5C:
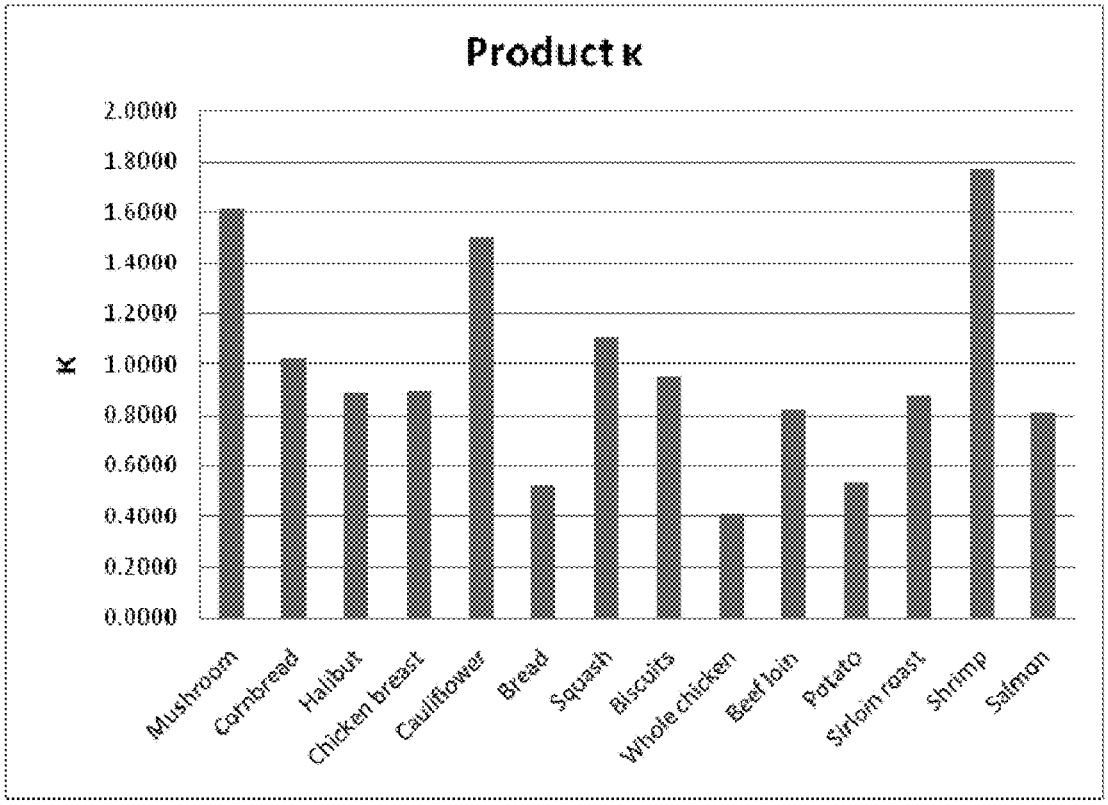
FIG. 5C illustrates an example chart showing kappa (κ) for a variety of food products according to an example embodiment.

Referring to FIG. 4B, it can be seen that there is not necessarily a common trend among efficiency of different food products based on initial mass. However, a generic exponential form for efficiency may be $Eff_\mu=\lambda*(1-e^{-1\times\alpha\times m})$, and a "generic" curve 190 defined as f(λ,α,m) in FIG. 4B may be used for untested or unknown product. In the example curve 190 of FIG. 4B, λ=0.83 and α=0.0015. It can be noted that the equation for "k" as a function of S times T (in units of RPM and Celsius, respectively) may be extrapolated through 0,0 as shown in FIG. 5B for a plurality of different foods. In some cases, the form for "k" as shown in Equation (9) as a function of S*T may be written (neglecting the small offset) as:

$$k=\kappa\times(S\times T) \quad (13$$

where slope kappa (κ) then becomes the sole variable needed to characterize a given product (along with the efficiency curve, if available). FIG. 5C illustrates an example chart showing kappa (κ) for a variety of food products. In some cases, variation in kappa (κ) may be attributed at least in part to the ratio of mass to surface area for a given food product. As such, a relationship may be defined in which increased surface area for a given mass, results in a larger kappa (κ). Table 1 below shows the variation in convective power over the range of product type for a sample m, S, and T:

TABLE 1

| Enter | m | S | T | $P_c$ (W) | $P_c$/g (W/g) |
|---|---|---|---|---|---|
| Average | 1000 | 3000 | 250 | 712.50 | 0.713 |
| Highest | | | | 1327.50 | 1.328 |
| Lowest | | | | 307.50 | 0.308 |

showing the wide variation in $P_c$.

Figure 5D:
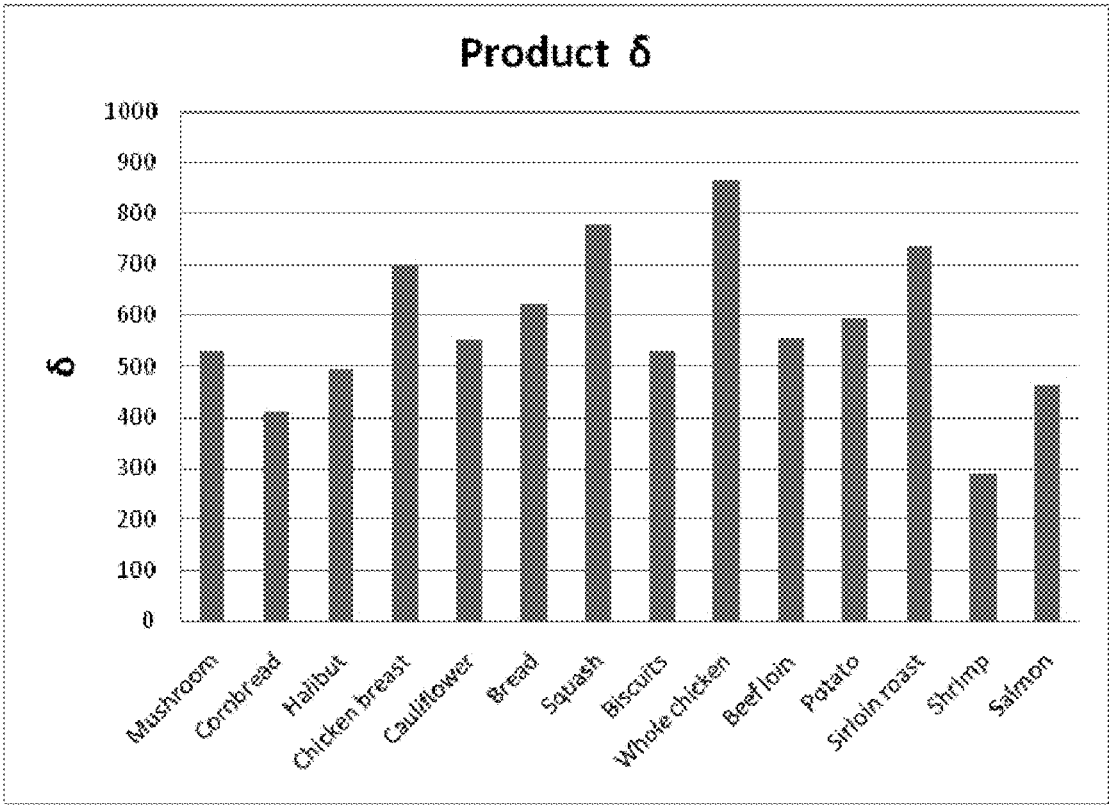
FIG. 5D illustrates an example chart showing the parameter δ according to an example embodiment.

In an example embodiment, food product characterizations, such as those discussed above, may describe the energy absorbed into the food as $E_f(m)$ from the thermodynamic properties of the food as shown for example in the equation $$E_f(m)=m\times C_p(C)\times\Delta T+\Delta m\times H_v,$$

where the total energy delivered to the food is a combination of the sensible and latent heat. In some cases, empirical data suggests that for given starting and ending food temperatures and a typical food product weight loss ($\Delta m$), the total energy absorbed by the food in cooking can be represented by a linear expression $E_f(m)=\delta\times m$. FIG. 5D illustrates an example chart showing the parameter δ. Inclusion of the parameter δ in a recipe signature may fully characterize the $E_f(m)$ component of Equations (11) and (12) above.

The parameter δ may be referred to as a food characterization parameter, which may be valid only for corresponding specific beginning and ending food temperatures. Thus, for example, the parameter δ may vary as a function of the initial food product temperature and the final food product temperature (or desired level or degree of doneness). For example, a steak may have an initial temperature of frozen (e.g., −20° C.), refrigerated (e.g., 2° C.), or room temperature (e.g., 20° C.) before going into the oven, and may have a desired degree of doneness of rare (e.g., 60° C.), medium (e.g., 65° C.), or well done (e.g., 70° C.). The parameter δ may be adjusted to accommodate each of these various potential initial and final temperature conditions. However, it should be appreciated that other initial and final values for the same or other types of food could also be used in other situations.

In some cases, a more general expression of the energy absorbed by food may therefore be employed. As an example, depending on the initial food product temperature ($T_i$) and final food product temperature ($T_f$), additional components may be selected and/or added as indicated below.

1) If frozen, then the energy to warm the product to the melting point may be:

$$E_{fwarm_frozen}(m)=m\times C_{p_frozen}(C)\times(0-T_i) \quad (14$$

2) If frozen, then the energy to melt the ice in the food product may be:

$$E_{f_melt}(m)=m\times H_o \quad (15$$

where $H_o$ is the latent heat of solidification of the food product.

3) Depending upon whether the product was frozen or not, the energy to heat the product to its final temperature (sensible energy) may be either:

$$E_{f_heat}(m)=m\times C_p(C)\times(Tf-0)+\Delta m\times H_v \quad (16$$

in the case of frozen product or:

$$E_{f_heat}(m)=m\times C_p(C)\times(T_f-T_i)+\Delta m\times H_v \quad (17$$

in the case of product above freezing.

4) The total energy absorbed by the food may be the conditional sum of the above terms:

$$E_f(m)=E_{fwarm_frozen}(m)+E_{fmelt}(m)+E_{f_heat}(m) \quad (18$$

Figure 5E:
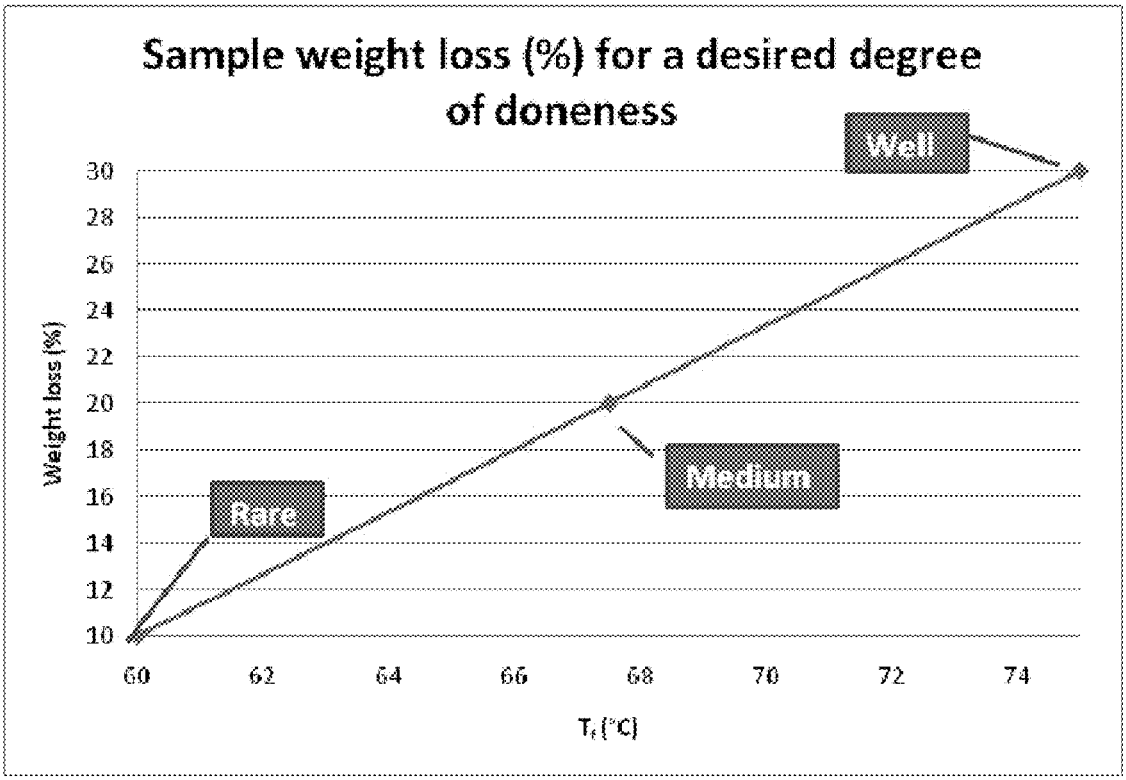
FIG. 5E illustrates an example chart of sample weight loss for a desired degree of doneness for steak according to an example embodiment.

In the example above, consideration of the "degree of doneness" may be handled by selecting a characterizing final food product temperature ($T_f$) and a characterizing weight loss (e.g., percentage of weight loss or weight loss (%)). FIG. 5E illustrates an example chart of sample weight loss for a desired degree of doneness for steak. In this example, weight loss (%) may be expressed as Weight loss (%)=1.33×$T_f$−70. A new generalized $E_f(m)$ of Equation ( ) can still be expressed as $$E_f(m)=\delta\times m$$

where the parameter δ varies with initial and final product states. A lookup table, spreadsheet and/or the expressions of weight loss (%) and the new generalized $E_f(m)$ may be used to generate discrete or continuous variations of the parameter δ for corresponding varying initial and final product conditions. Again, using steak as an example, the following table illustrates some example values of the parameter δ.

Energy in food characterization parameter (δ) as a function of initial and final conditions

| | | Doneness | | |
|---|---|---|---|---|
| | | Rare | Medium | Well |
| Initial state | Frozen | 677 | 927 | 1177 |
| | Chilled | 411 | 661 | 911 |
| | Room temperature | 353 | 603 | 853 |

Energy in the food characterization parameter δ may be selected by the user from a graphical user interface (GUI) in the form of a doneness selector and/or an initial condition selector. In some embodiments, the doneness selector and/or initial condition selector may be a slider bar, a value entry field, a selectable icon or any other suitable mechanism for indicating values in the GUI. After a value is selected for initial and/or final conditions, a corresponding parameter δ may be used to determine the energy absorbed by the food and the value of energy absorbed by the food may be used for cook time calculations and determinations regarding the RF energy delivered to the food product.

In an example embodiment, the cooking controller 40 may also therefore determine, at a current time, a change to the amount of cooking time remaining for application of energy associated with the first energy source 20 based on a monitored amount of energy added via the first energy source 20 up to the current time, given a mass of the food product being cooked and the efficiency of the food product at that mass, and based on changes made to cooking parameters associated with the second energy source 30 (e.g., air speed and air temperature). As such, the energy delivered by the first energy source 20 is monitored relative to a target energy value for a selected doneness level. Then, as changes are made to energy delivered via the second energy source 30, where those changes are indicated by user selected changes to cooking parameters (e.g., air speed and air temperature), the cooking controller 40 may be configured to determine a modified cooking time to achieve the selected doneness level.

As an example, where two energy sources are provided including a first energy source that is monitored by electronics and used to countdown progress (e.g., RF energy counted down to a final RF energy value, which may be converted into time based on average RF energy delivery rates), and a second energy source that is un-monitored, but is adjustable by a user (e.g., convective heat with an adjustable air speed and air temperature), a target RF energy level may be 300 kJ. If the total delivered energy at a particular instant in time (e.g., 5 minutes into the cooking program) is 100 kJ, the calculated average power from the start may be 100 kJ divided by 5 minutes or 333.33 Watts (with the conversion from minutes to second accounted for). The remaining energy needed to reach the target RF energy level may be 200 kJ, and thus, the time remaining at the average power may be 600 seconds or 10 minutes. Adding more heat due to the conductive sources may be accounted for by the cooking controller 40 to revise the remaining time accordingly based on the new energy delivery rate that accounts for the conductive heat addition.

Figure 6:
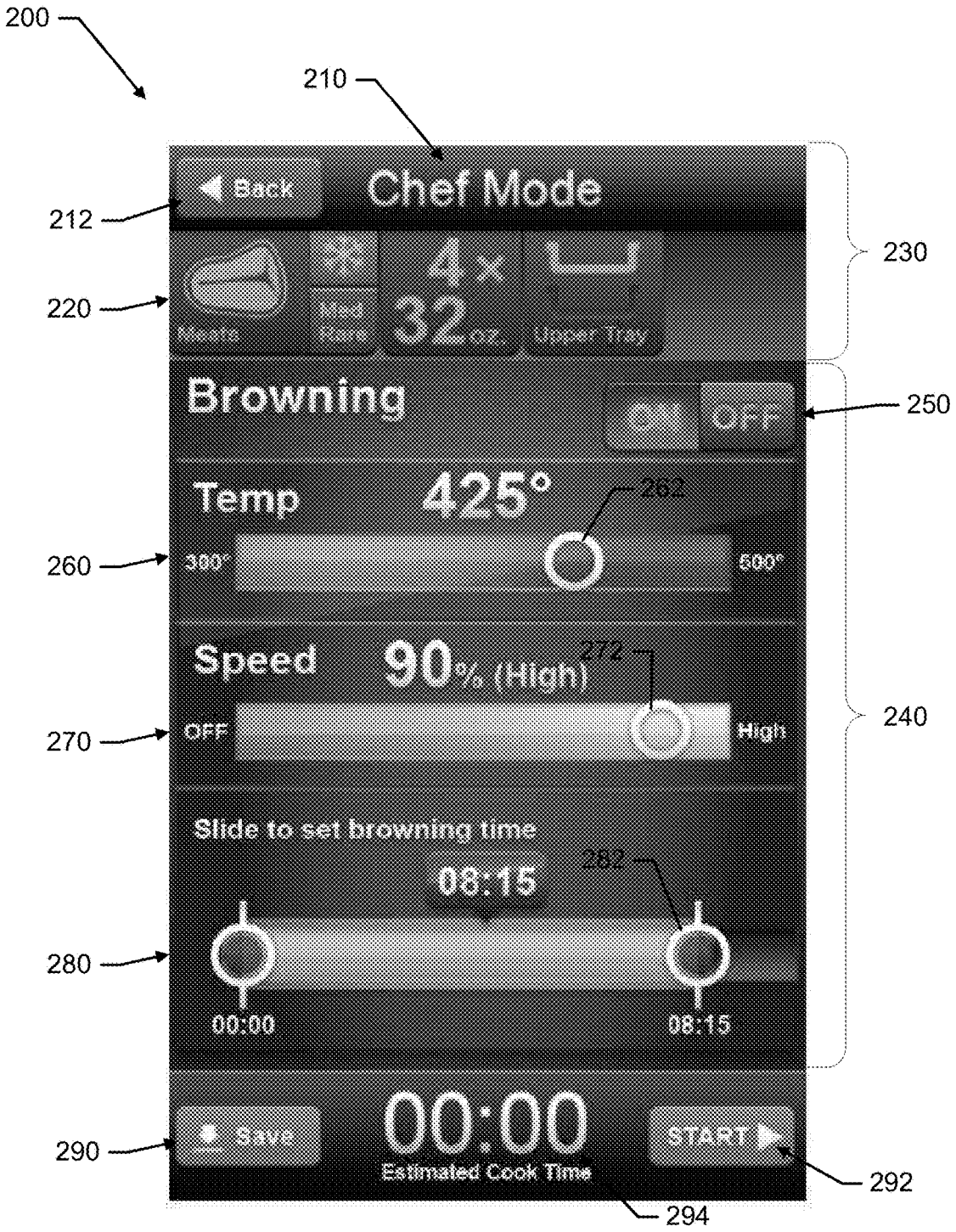
FIG. 6 illustrates a screen shot of a control console according to an example embodiment.

In an example embodiment, the cooking controller 40 may provide (e.g., via the user interface 140) the operator with an intuitive interface for controlling browning operations of the oven 10. The operator inputs provided via the user interface 140 may define the changes made to the energy delivered via the second energy source 30. These operator inputs may therefore define the changes made to the cooking parameters that form the basis for determining a new cooking time for the food product. FIG. 6 illustrates an example of a user interface that may be employed by the cooking controller 40 according to an example embodiment. As shown in FIG. 6, the user interface 140 may present (e.g., responsive to direction by the processing circuitry 100) a control console 200. Control console 200 may be one screen among a plurality of different control screens that may be provided via the user interface 140 by the cooking controller 40 to facilitate provision of instructions by the user to the oven 10 and/or to facilitate provision of feedback, options, or data to the user. In an example embodiment, the processing circuitry 100 may be configured to determine which of a plurality of different control console screens to present to the user based on an operating mode of the oven. As such, for example, multiple different operating modes may exist (e.g., based on operator experience level and/or an operators desired level of interaction/control) and each operating mode may have a corresponding different selectable control console screen for browning control associated therewith.

The control console 200 may indicate a current operating mode 210 and provide navigation options (e.g., back button 212). In some embodiments, the control console 200 may also provide an indication of initial conditions via a selection indicator 220. The selection indicator 220 may list or otherwise identify the initial conditions that may have been entered by the operator or that may be default conditions or previously existing conditions (e.g., from the last entered data). The current operating mode 210 and the selection indicator 220 may be provided at a mode related portion 230 of the control console 200. In this regard, the mode related portion 230 of the control console 200 may provide information that is specific to the current mode (e.g., chef mode in this example), but is not specific to a current control operation. As such, the control console 200 may also include a current control operation portion 240 that may provide indications or options that are specific to the control operation that is enabled to be manipulated via the current screen displayed on the control console 200.

In an example embodiment, the control console 200 may include a browning control operation. FIG. 6 specifically indicates one example of a current control operation portion 240 for manipulation of browning control. It should be noted that although some example embodiments of the control console 200 include at least one display portion that is generic to the current mode of operation (e.g., the mode related portion 230) and another display portion that is specific to the current control operation within that mode of operation (e.g., the current control operation portion 240), some embodiments may display only the current control operation portion 240 without any generic mode related information.

Browning control may be turned on or off via control selector 250. When browning control is turned off, either no browning may be applied at all (e.g., via a operation of the cooking controller 40 to use only the first energy source 20, or at least not use the second energy source 30) or any browning control may be conducted via default settings. In an example embodiment, browning control selectors may be provided for parameters including temperature, air speed and browning time. In some embodiments, the browning control selectors may each be provided with slider bars or other selectable elements that may be selectively positioned by the operator within the corresponding spectrum of available options defined by the range covered by each respective browning control selector. As shown in FIG. 6, a temperature selector 260 may include a range of temperature values displayed over a scale (e.g., 300 F to 500 F) and a slider bar 262 that may be slid over any portion of the scale to select the air temperature for the second heating source 30 (e.g., for air heater 34). An air speed selector 270 may also be provided to include a range of air speeds (e.g., from off to maximum or high speed, or 0% to 100%) that may be selected using slider bar 272 to control airflow (e.g., via airflow generator 32). A time selector 280 may also be provided to enable the user to use slider bar 282 to select an amount of time for the application of heated airflow for browning. Although not necessary, the browning control selectors may be color coded along their respective ranges to further illustrate the values represented. In embodiments, the selected browning time may be displayed proximate to the slider bar 282 and/or the time selector 280. Selections that are made may be saved to a particular program using save button 290, and execution of the settings provided may be initiated using the start button 292. A total estimated cook time 294 for the current program may also be provided.

Figure 7:
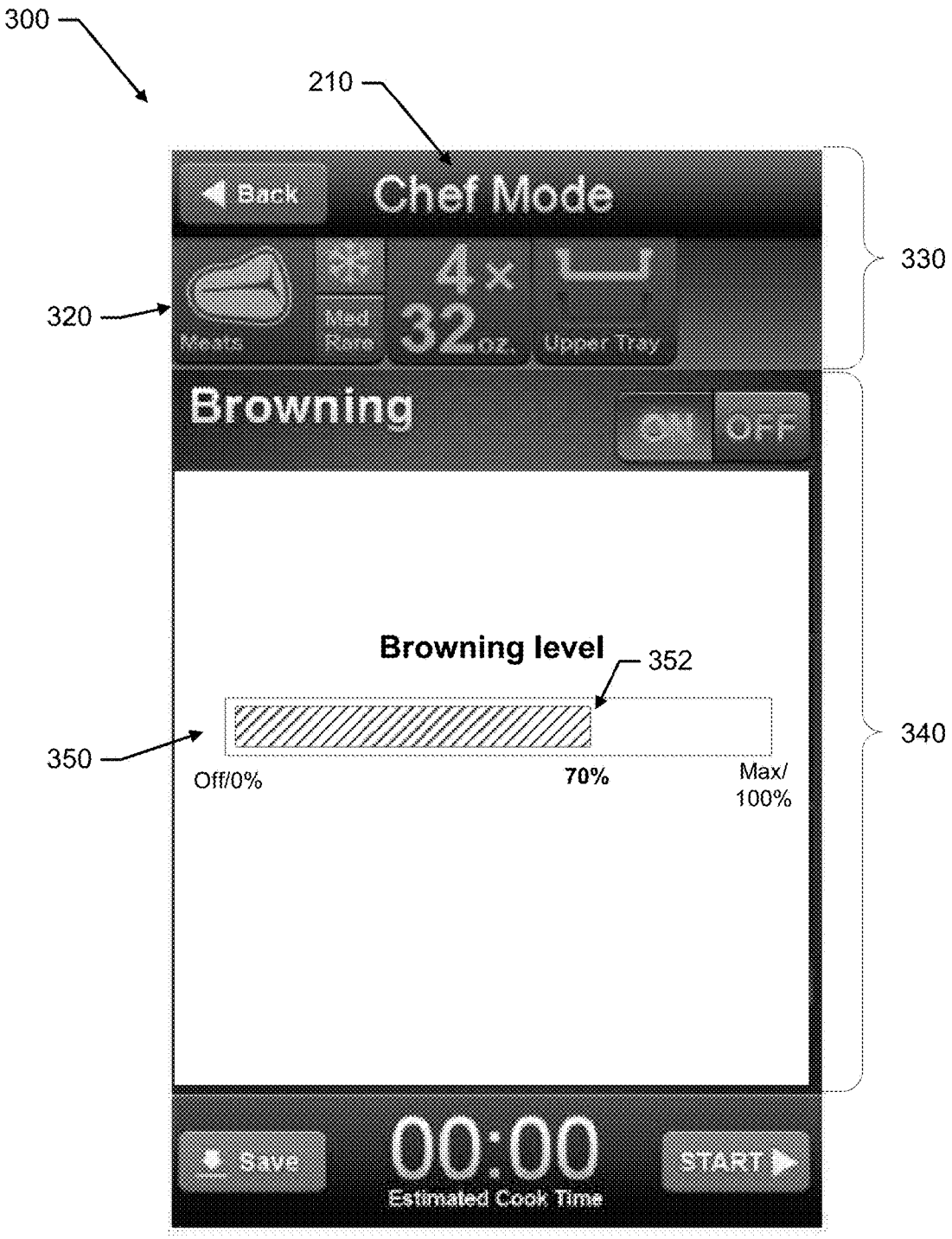
FIG. 7 illustrates a screen shot of an alternative control console according to an example embodiment.

FIG. 7 illustrates a simplified example of a control console for controlling browning according to an example embodiment. As shown in FIG. 7, the control console 300 may include a mode related portion 330 indicating a current operating mode 310 and the selection indicator 320. However, in this example, the current control operation portion 340 may be simplified relative to the example of FIG. 6. In this regard, a single browning controller 350 may be provided with a slidable selector 352 that selects browning over a range from none to maximum (or 0% to 100%). Dependent upon the position of the slidable selector 352, the cooking controller 40 may apply secondary energy to affect browning.

In the example of FIG. 6, the cooking controller 40 may apply the selected temperature and air speed, as indicated by slider bars 262 and 272, for the selected time, as indicated by slider bar 282. This may give the user very detailed control over browning parameters to be employed. However, in the example of FIG. 7, a more simple operational mode (e.g., a guided or automatic mode) may be provided in which the user may simply provide an indication of a degree of browning that is desired and the cooking controller 40 may determine the temperature, air speed and time control parameters for delivery of the corresponding amount of browning. In this regard, the cooking controller 40 may access data tables that indicate, for the initial conditions entered, the amount of time to apply a certain temperature and/or air speed to achieve a specific level of browning. The cooking controller 40 may then select the corresponding parameters via control of the second energy source 30.

In some embodiments, a combination of the above two examples may be provided. In such an example, the cooking controller 40 may display selected temperature and air speed settings (and/or a time value) based on a selected browning level. However, the user may be enabled to adjust the time, temperature or air speed to control one or more of those parameters. The cooking controller 40 may then adjust other parameters in order to achieve the selected browning level given the specific value selected by the user. For example, if the user selects a medium level of browning, the cooking controller 40 may select an air speed, time and temperature (based on table values for the initial conditions entered) and present the selected parameters to the user. If the user wants to shorten the time, the temperature and/or air speed may be increased by the cooking controller 40 in order to shorten the browning time. If the user wants to lower the temperature, the cooking controller 40 may increase the time and/or air speed in order to allow for the selected level of browning to be achieved with the lower temperature selected. Meanwhile, if the user wants to use a lower air speed (e.g., for a delicate item), the cooking controller 40 may increase the temperature and/or time to achieve the desired level of browning with the selected lower air speed.

In some embodiments, the cooking controller 40 may also adjust cooking parameters associated with the first energy source 20 based on adjustments made to the browning control. Thus, for example, as browning levels are increased, the additional heat to which the food product will be subjected may be accounted for by the cooking controller 40 so that the cooking controller 40 may reduce levels or the time of application of the first energy source 20. Accordingly, the cooking controller 40 may provide a robust control mechanism by which the quality of food product cooked by the oven 10 may be preserved. In this regard, for example, the cooking controller 40 may provide for a robust control capability for the operator with respect to browning of food product in an oven that employs RF energy as a primary heat source and another energy source for browning as a secondary heat source.

When initially programmed cooking is complete, the operator may remove the cooked food product and secure cooking operations. However, in some instances, the operator may wish to take additional actions relative to the food product. For example, the operator may wish to save an executed program for duplication of the cooking program in the future. Alternatively, the operator may wish to add further cook time using either or both of the first and second energy sources 20 and 30. FIGS. 8-11 illustrate some example screens that may be encountered to assist the operator in finishing a product after initially executed programming has been completed.

Figure 8:
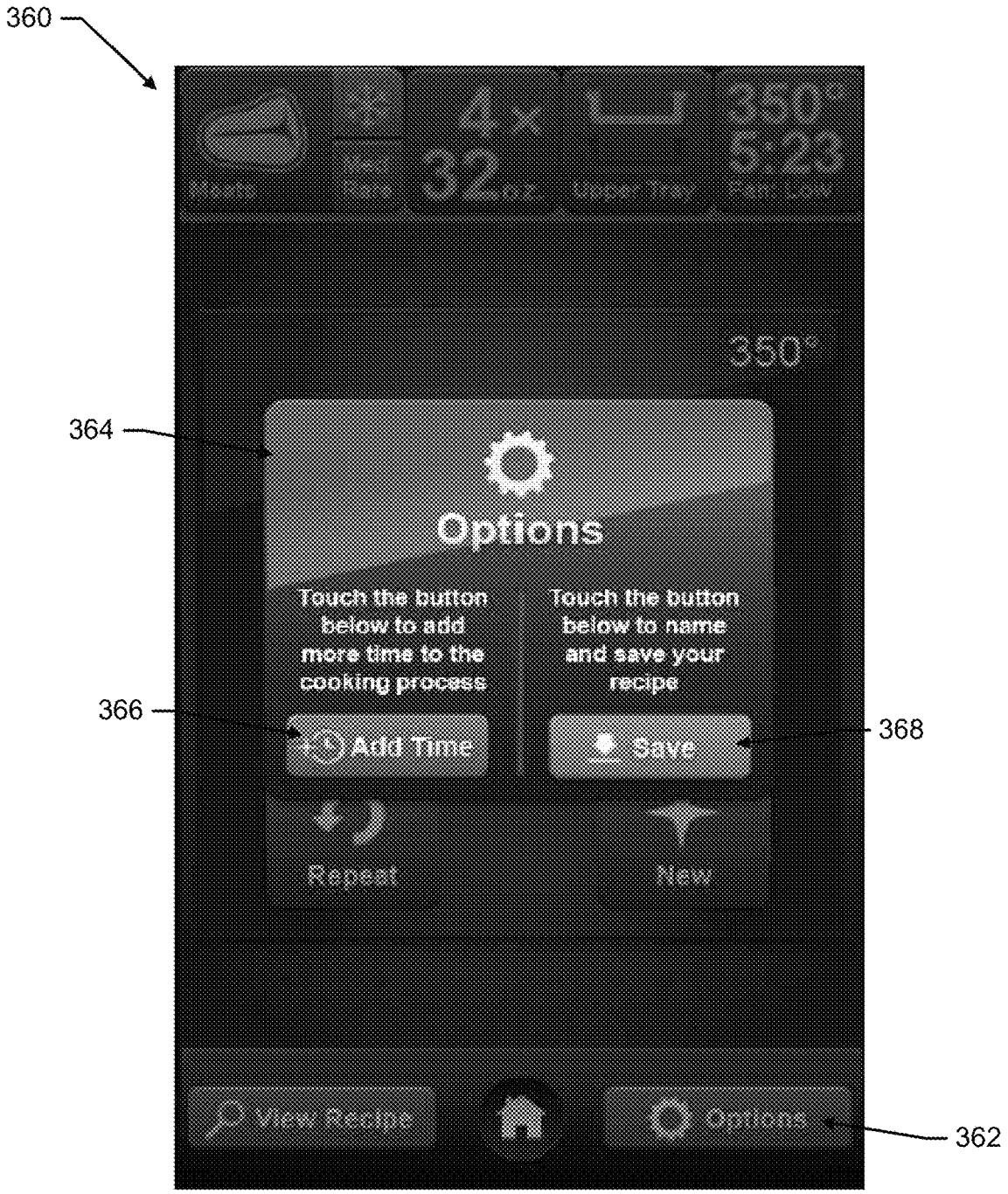
FIG. 8 illustrates one example of a control console presentable during a finishing sequence for selecting an option to add browning time according to an example embodiment.

In this regard, FIG. 8 illustrates one example of a control console presentable during a finishing sequence for selecting an option to add browning time according to an example embodiment. In this regard, for example, a finishing option page 360 may be presented with at least one option for finishing the cooking sequence. For example, options may be presented to select a new cooking program, to repeat the program just completed, to view the recipe, to stop the cooking process, or to see further options (e.g., via options button 362). In an example embodiment, selection of the options button 362 may result in presentation of a control console 364 that enables the user to add more time to the cooking process by selecting an add time button 366 and/or to save the program just completed as a recipe by selecting a save button 368.

Figure 9:
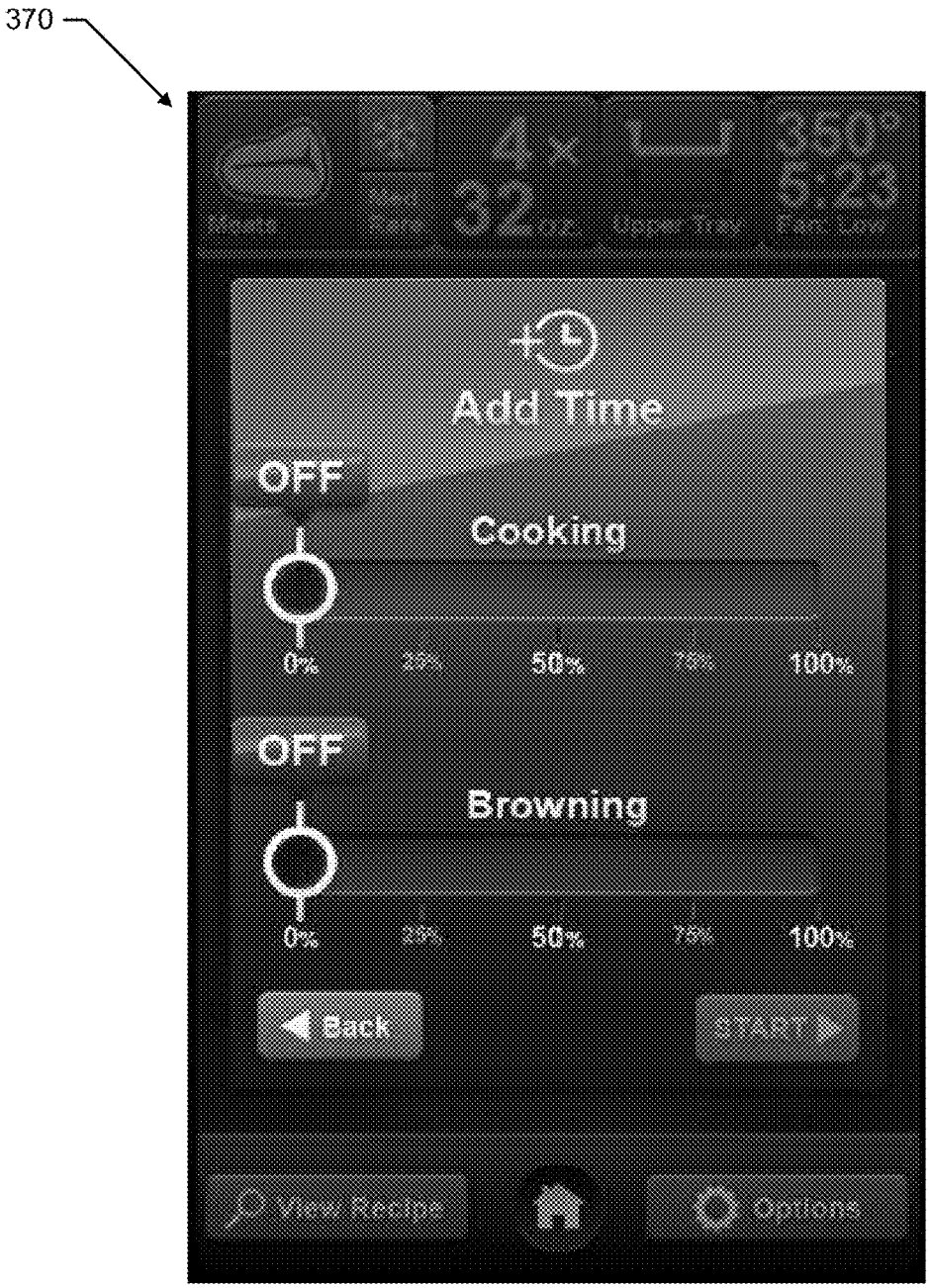
FIG. 9 illustrates an example of a control console for enabling selection of additional browning time according to an example embodiment.

In an example embodiment, selection of the add time button 366 may launch a control console FIG. 9 illustrates an example of a time addition control console 370 for enabling selection of additional browning time and/or cooking time according to an example embodiment. As shown in FIG. 9, the operator may select to turn on additional cooking and/or browning. Then, as is shown in the enabled control console 372 of FIG. 10, each cooking selector that is enabled may be individually operated to increase the corresponding time for application of the corresponding energy source. In some cases, the operator may slide a controller to increase cooking time and browning time independently of one another. As the operator slides each respective controller, the additional time selected for the application of the corresponding energy source may be presented. In some cases, the additional time may be selected as a percentage of the initial time selected for application of the corresponding energy source. The operator may then select a start button to initiate the addition of energy based on the selections made in the enabled control console 372.

Figure 10:
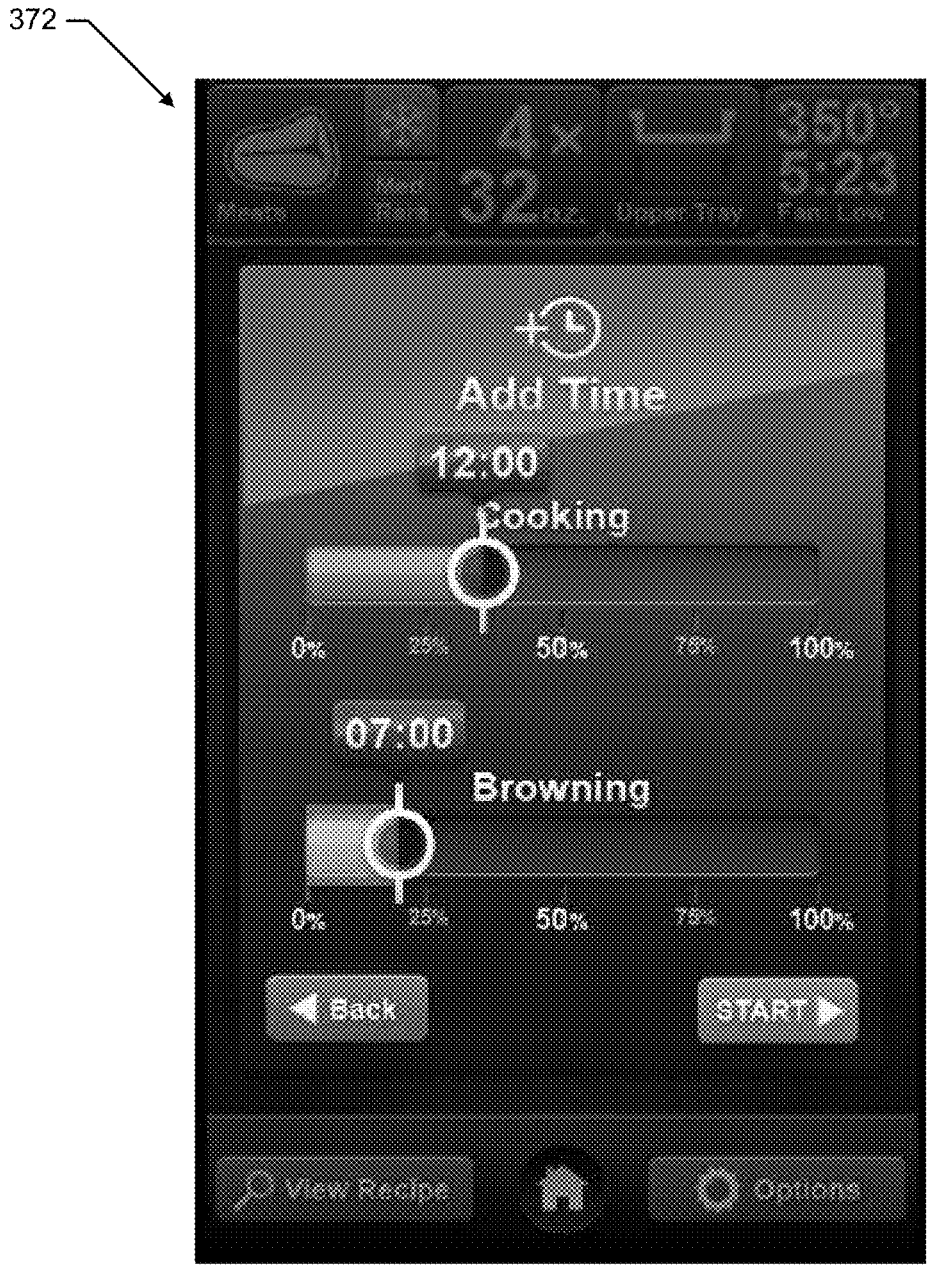
FIG. 10 illustrates the addition of further browning time according to an example embodiment.
Figure 11:
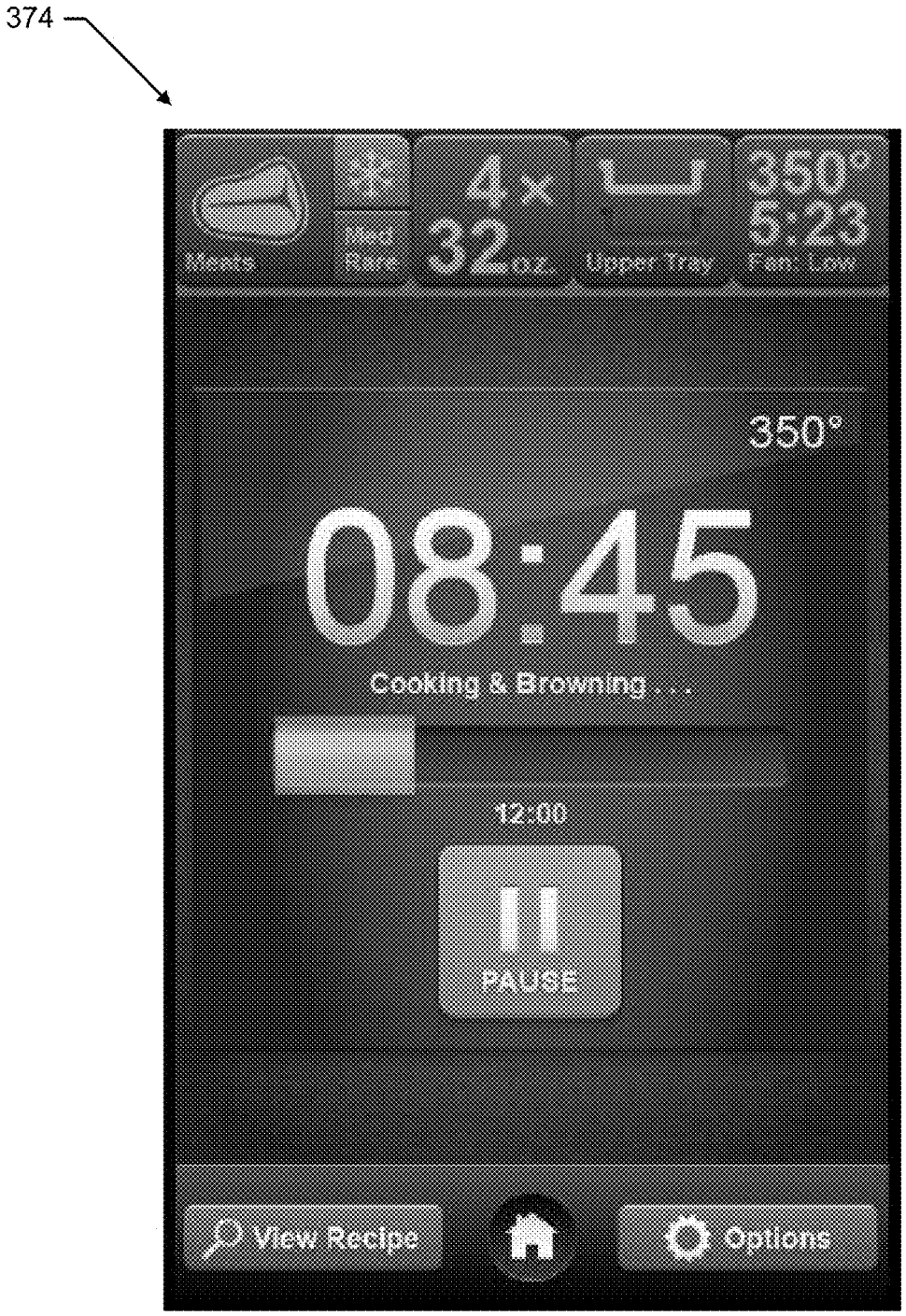
FIG. 11 illustrates an activity summary screen illustrating additional cooking and browning time added to a program or recipe executed according to an example embodiment.

In an example embodiment, after browning adjustments are made by directly changing air temperature and/or air speed values as shown in FIG. 6, or by indirectly changing such values by adding to the browning level (as shown in FIG. 7) or browning time (as shown in FIG. 10), the cooking controller 40 may apply the inputted or determined values for air speed and air temperature to use the modification algorithm 152 to determine a new cooking time (as shown in FIG. 11). In this regard, FIG. 11 illustrates an activity summary screen 374 illustrating additional cooking and/or browning time added to a program or recipe executed according to an example embodiment. As such, according to FIG. 11, the cooking controller 40 may be configured to determine a modification to the cooking program 150 by employing the modification algorithm 152 to determine an updated cooking time (shown in FIG. 11) relating to application of energy via at least the first energy source. In some cases, the updated cooking time may be determined based on dividing an amount of energy to be delivered to the food product by a sum of average power delivered by radio frequency (RF) sources and an estimate of average power delivered by convective sources (e.g., as indicated by equation (11)). As an alternative to presentation of an updated time, determining the modification to the cooking program 150 may sometimes include employing the modification algorithm 152 to determine an updated countdown indicator relating to a total amount of radio frequency (RF) energy delivered via the first energy source to achieve the selected doneness level (e.g., as shown in equation (12)). In such an example, the updated countdown indicator may be presented as a percentage of total energy remaining to be provided or as an amount of energy to be provided. The value presented in the updated countdown indicator may be determined based on dividing a product of an updated cooking time and average power delivered by radio frequency (RF) sources by an RF efficiency of the food product at the given mass. Accordingly, the cooking controller 40 may utilize the values input via the user interface 140 (or values determined based on the values input via the user interface 140) along with equations (11) and (12) to make the corresponding determinations regarding either an updated time or an updated countdown to the achievement of the amount of energy needed to achieve the desired doneness level.

Figure 12:
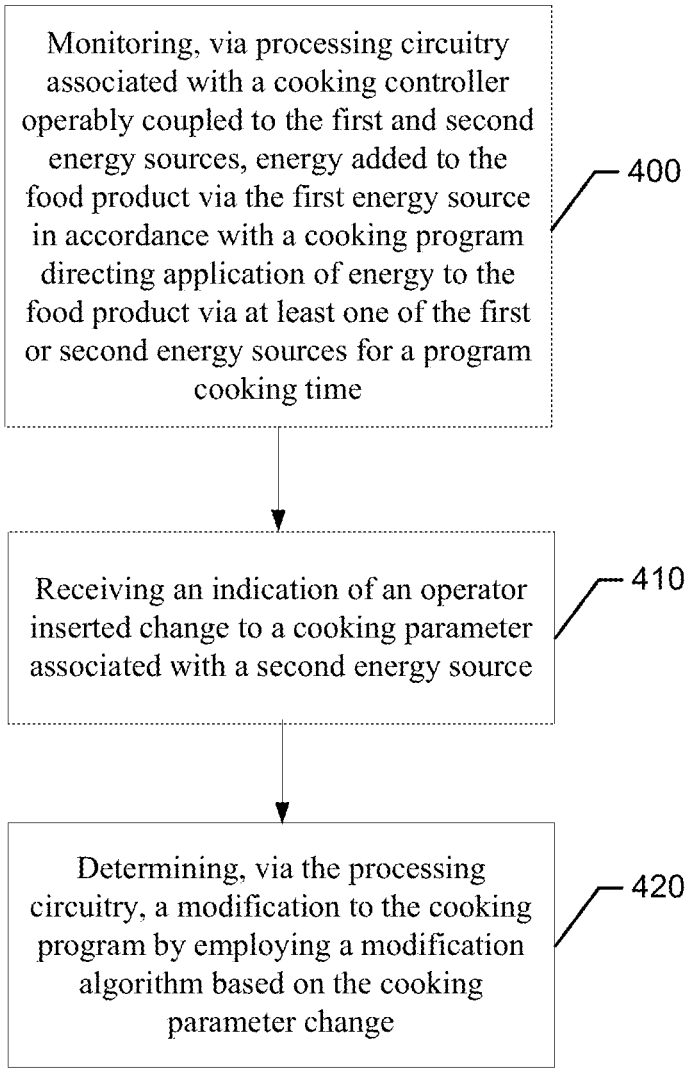
FIG. 12 illustrates a method according to an example embodiment.

FIG. 12 is a flowchart of a method and program product according to an example embodiment of the invention. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device of a user terminal (e.g., oven 10) and executed by a processor in the user terminal.

As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the invention, as shown in FIG. 12, may include monitoring energy added to a food product via a first energy source in accordance with a cooking program at operation 400. The method may further include receiving an indication of an operator inserted change (e.g., via a user interface) to a cooking parameter associated with a second energy source at operation 410. The method may further include determining a modification to the cooking program by employing a modification algorithm based on the cooking parameter change at operation 420. The modification algorithm may include instructions for determining a change (e.g., an updated cooking time) to the energy to be applied via the first energy source to achieve a selected level of doneness associated with the cooking program (e.g., based on an efficiency of a given mass of the food product), an amount of energy provided by the first energy source up to a point in the cooking program at which the cooking parameter change was made, and the cooking parameter change (e.g., the changed air temperature or air speed) associated with the second energy source.

In an example embodiment, an apparatus for performing the method of FIG. 12 above may comprise a processor (e.g., the processor 110) configured to perform some or each of the operations (400-420) described above. The processor may, for example, be configured to perform the operations (400-420) by performing hardware implemented logical functions, executing stored instructions, or executing algorithms for performing each of the operations.

Some example embodiments may also be applicable to phased cooking where different levels of energy may be applied from the first energy source 20 and/or the second energy source 30 during different phases of a cooking program. Phased cooking may be useful or even necessary for a number of cooking processes. For example, phased cooking may be used in connection with some delicate food products, or food products that require thawing or some level of cooking to give the food product a certain level of stability prior to the application of hot air to the food product such that only RF cooking is performed for a given period of time prior to the application of convective heat. In phased cooking scenarios, different first and second energy source values may be provided in each phase. Thus, the second (convective) energy delivered can be computed by time integration of $P_c$ over the time elapsed in the appropriate phase. For example, if RF power level 1 and $P_c$~0 watts are employed in phase A, and RF power level 1 and $P_c$~300 watts are employed in phase 2, energy delivered at a given instant during the cooking cycle may be determined by $E_{inst}=t_A*P_\mu+t_B*(P_c+P_\mu)$, where the instant considered is at a time $t_B$ in the second phase of the cycle with $t_B=0$ at the beginning of the phase.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a cooking chamber configured to receive a food product;

a user interface configured to display information associated with processes employed for cooking the food product;

a first heat source providing primary heating of the food product placed in the cooking chamber;

a second heat source providing secondary heating for the food product; and a cooking controller operably coupled to the first and second heat sources to execute instructions associated with a cooking program directing application of energy to heat the food product via at least one of the first or second heat sources, the cooking controller including processing circuitry configured to:

monitor energy added to heat the food product via the first heat source in accordance with the cooking program;

receive an indication of an operator inserted change to a cooking parameter associated with the second heat source; and determine a modification to the cooking program by employing a modification algorithm based on the cooking parameter change, the modification algorithm including instructions for determining a change to the energy to be applied via the first heat source to achieve a selected level of doneness associated with the cooking program, wherein the selected level of doneness is associated with a corresponding target energy level for the food product, the change to the energy to be applied being determined based on a difference between an amount of energy provided by the first heat source up to a point in the cooking program at which the cooking parameter change was made, and energy remaining to achieve the corresponding target energy level based on the cooking parameter change associated with the second heat source.

2. The oven of claim 1, wherein receiving the indication of the operator inserted change comprises receiving an indication of a change to an air temperature or air speed associated with adding energy via the second heat source.

3. The oven of claim 2, wherein receiving the indication of the change comprises receiving a direct input to alter the air temperature or air speed via the user interface or receiving an input modifying a browning level or browning time via the user interface and determining a corresponding change to the air temperature or air speed.

4. The oven of claim 2, wherein receiving the indication of the change comprises receiving an input modifying the cooking program relative to energy added by the first heat source or the second heat source either before or during execution of the cooking program.

5. The oven of claim 1, wherein determining the modification to the cooking program comprises employing the modification algorithm to determine an updated program cooking time relating to application of energy via the first heat source.

6. The oven of claim 5, wherein one of the first heat source or the second heat source is a radio frequency (RF) source, and wherein the updated cooking time is determined based on dividing an amount of energy to be delivered to the food product by a sum of average power delivered by the RF source and an estimate of average power delivered by convective sources.

7. The oven of claim 1, wherein determining the modification to the cooking program comprises employing the modification algorithm to determine an updated countdown indicator relating to energy delivered by one or both of the first and second heat sources.

8. The oven of claim 1, wherein determining the modification to the cooking program comprises employing the modification algorithm to determine an updated countdown indicator relating to a total amount of radio frequency (RF) energy delivered via the first heat source to achieve the selected doneness level.

9. The oven of claim 8, wherein one of the first heat source or the second heat source is a radio frequency (RF) source, and wherein the updated countdown indicator is determined based on dividing a product of an updated cooking time and average power delivered by the RF source by an RF efficiency of the food product at the given mass.

10. The oven of claim 1, wherein the selected level of doneness is determined based on an efficiency of a given mass of the food product.

11. The oven of claim 1, wherein the cooking controller is configured to employ a food characterization parameter determined based at least in part on an initial temperature of the food product and the selected level of doneness in order to determine energy absorption within the food product.

12. A cooking controller for use in an oven, the oven including a first heat source providing primary heating of a food product placed in the oven and a second heat source providing secondary heating for the food product, the cooking controller operably coupled to the first and second heat sources to execute instructions associated with a cooking program directing application of energy to heat the food product via at least one of the first or second heat sources and comprising processing circuitry configured to:

monitor energy added to heat the food product via the first heat source in accordance with the cooking program;

receive an indication of an operator inserted change to a cooking parameter associated with the second heat source; and determine a modification to the cooking program by employing a modification algorithm based on the cooking parameter change, the modification algorithm including instructions for determining a change to the energy to be applied via the first heat source to achieve a selected level of doneness associated with the cooking program, wherein the selected level of doneness is associated with a corresponding target energy level for the food product, the change to the energy to be applied being determined based on a difference between an amount of energy provided by the first heat source up to a point in the cooking program at which the cooking parameter change was made, and energy remaining to achieve the corresponding target energy level based on the cooking parameter change associated with the second heat source.

13. The cooking controller of claim 12, wherein receiving the indication of the operator inserted change comprises receiving an indication of a change to an air temperature or air speed associated with adding energy via the second heat source.

14. The cooking controller of claim 13, wherein receiving the indication of the change comprises receiving a direct input to alter the air temperature or air speed via the user interface or receiving an input modifying a browning level or browning time via the user interface and determining a corresponding change to the air temperature or air speed.

15. The cooking controller of claim 13, wherein receiving the indication of the change comprises receiving an input modifying the cooking program relative to energy added by the first heat source or the second heat source either before or during execution of the cooking program.

16. The cooking controller of claim 12, wherein determining the modification to the cooking program comprises employing the modification algorithm to determine an updated program cooking time relating to application of energy via the first heat source.

17. The cooking controller of claim 16, wherein one of the first heat source or the second heat source is a radio frequency (RF) source, and wherein the updated cooking time is determined based on dividing an amount of energy to be delivered to the food product by a sum of average power delivered by the RF source and an estimate of average power delivered by convective sources.

18. The cooking controller of claim 12, wherein determining the modification to the cooking program comprises employing the modification algorithm to determine an updated countdown indicator relating to a total amount of radio frequency (RF) energy delivered via the first heat source to achieve the selected doneness level.

19. The cooking controller of claim 18, wherein one of the first heat source or the second heat source is a radio frequency (RF) source, and wherein the updated countdown indicator is determined based on dividing a product of an updated cooking time and average power delivered by the RF source by an RF efficiency of the food product at the given mass.

* * * * *